US012152581B1

(12) United States Patent
Davis

(10) Patent No.: US 12,152,581 B1
(45) Date of Patent: Nov. 26, 2024

(54) COMPRESSION PUMP

(71) Applicant: Brian Lee Davis, Ripon, WI (US)

(72) Inventor: Brian Lee Davis, Ripon, WI (US)

( * ) Notice: Subject to any disclaimer, the term of this patent is extended or adjusted under 35 U.S.C. 154(b) by 0 days.

(21) Appl. No.: 18/376,303

(22) Filed: Oct. 3, 2023

Related U.S. Application Data

(60) Provisional application No. 63/424,695, filed on Nov. 11, 2022, provisional application No. 63/413,195, filed on Oct. 4, 2022.

(51) Int. Cl.

| | |
|---|---|
| ***F04B 53/12*** | (2006.01) |
| ***F04B 39/00*** | (2006.01) |
| ***F04B 43/00*** | (2006.01) |
| ***F04B 45/04*** | (2006.01) |
| ***F04B 53/14*** | (2006.01) |

(52) U.S. Cl.
CPC ..... *F04B 53/12* (2013.01); *F04B 39/0016* (2013.01); *F04B 43/0054* (2013.01); *F04B 45/045* (2013.01); *F04B 53/143* (2013.01); *F04B 53/147* (2013.01)

(58) Field of Classification Search
CPC .. F04B 53/14; F04B 39/0016; F04B 43/0054; F04B 45/045; F04B 53/12; F04B 53/143; F04B 53/147
See application file for complete search history.

(56) References Cited

U.S. PATENT DOCUMENTS

| | | | | |
|---|---|---|---|---|
| 811,330 | A * | 1/1906 | Roth | F04B 43/0054 92/99 |
| 5,690,017 | A | 11/1997 | Riedlinger | |
| 2004/0197201 | A1 | 10/2004 | Moisidis | |

FOREIGN PATENT DOCUMENTS

| | | | | |
|---|---|---|---|---|
| CN | 103147965 | | 6/2013 | |
| CN | 103244393 | | 8/2013 | |
| FR | 2200908 | * | 4/1974 | F04B 45/043 |
| GB | 2395237 | * | 5/2004 | F04B 35/045 |

OTHER PUBLICATIONS

FR2200908 translation (Year: 2024).*
Keepwin Technology Hebei Co., Ltd, What is a Diaphragm Compressor, stated date of Apr. 16, 2022, as viewed at https://keep-win/solution/289.html on Dec. 21, 2023. 9 pages.
(Continued)

*Primary Examiner* — Charles G Freay
*Assistant Examiner* — David N Brandt
(74) *Attorney, Agent, or Firm* — Brannen Law Office, LLC

(57) ABSTRACT

A compression pump has a bladder that is supported during the compression stroke on the low-pressure side of the bladder, and that can have a compression cavity that is fully evacuated during each stroke. The compression pump can have a housing with an entrance section, a center section, and a crown section. The entrance and center sections define seats to receive bridge bearings (of bridges each having a rod and a bearing). A piston can have an inlet section, a middle section, and a head section. The inlet and middle sections define seats to receive groove bearings. The bridges and groove bearings structurally hold a support structure, which supports the bladder. The support structure can be a slide support that changes shape as the piston moves within the housing. The piston head can have a valve seat that the inlet valve head is received within when it is closed.

26 Claims, 45 Drawing Sheets

(56) References Cited

OTHER PUBLICATIONS

English language abstract of CN103147965A, as viewed at https://worldwide.espacenet.com/patent/search/family/048546225/publication/CN103147965A?q=cn103147965 on Dec. 21, 2023. 1 page.
English language abstract of CN103244393A, as viewed at https://worldwide.espacenet.com/patent/search/family/048924163/publication/CN103244393A?q=pn%3DCN103244393A on Dec. 21, 2023. 1 page.

* cited by examiner

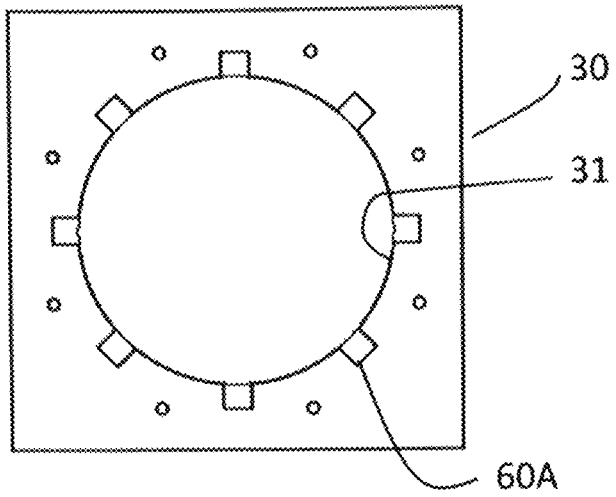
FIG. 12
FIG. 13
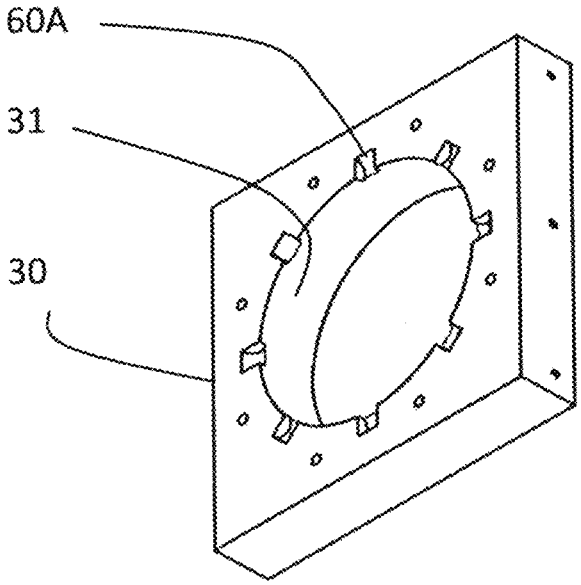

FIG. 93
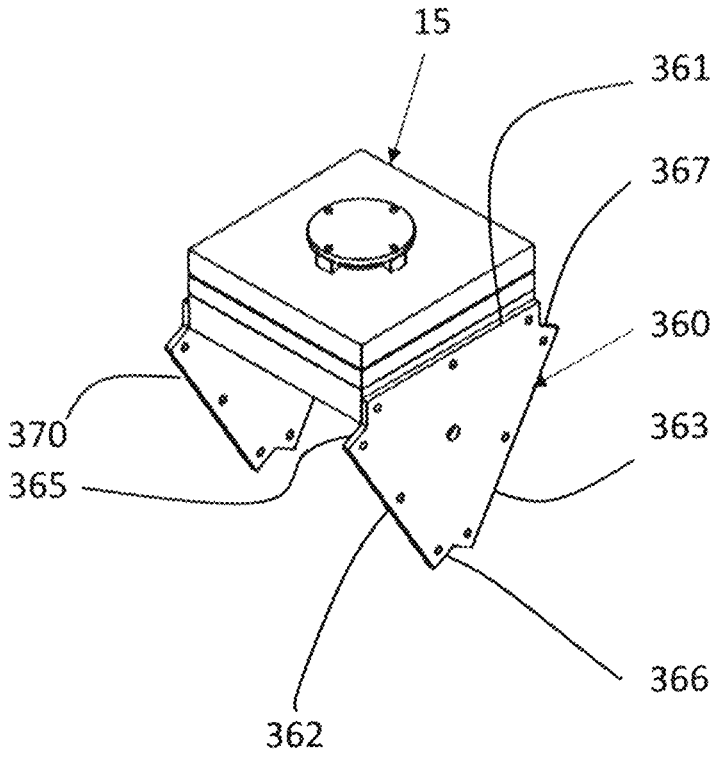
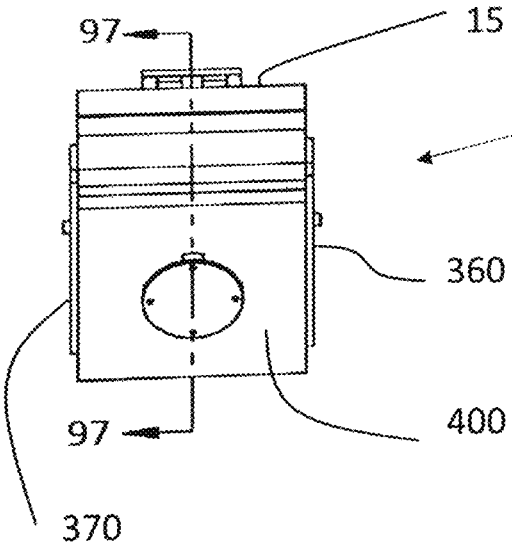
FIG. 94

FIG. 95
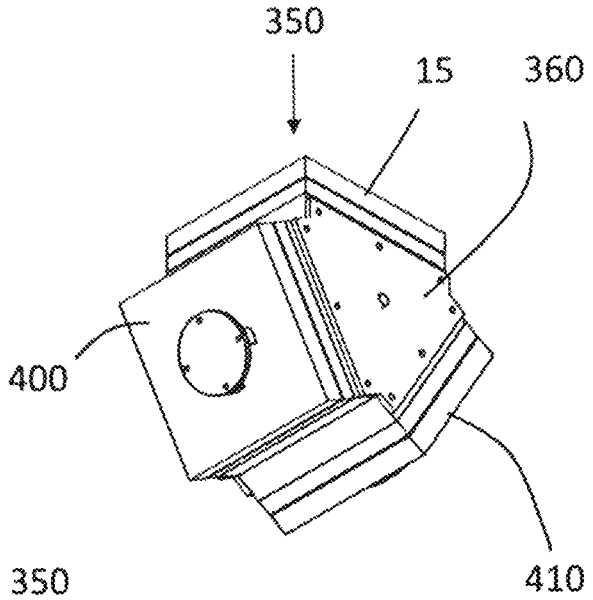
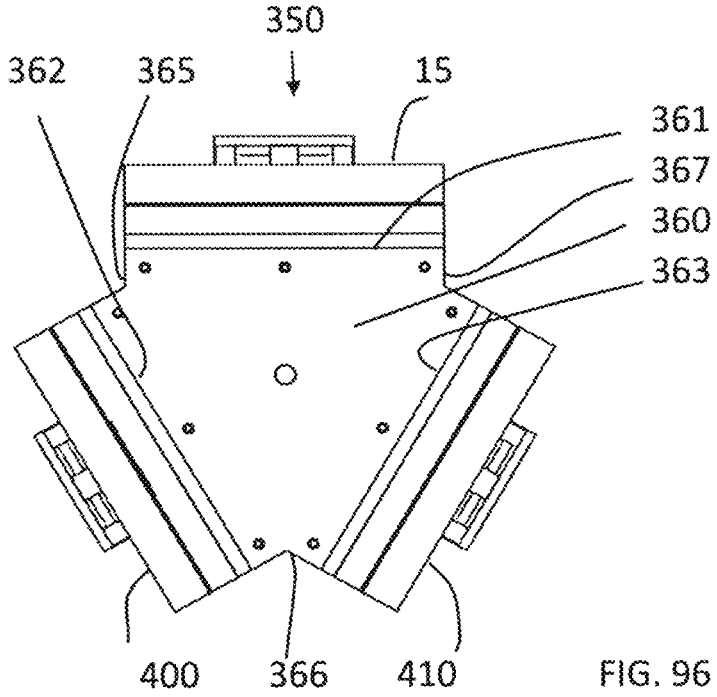
FIG. 96

COMPRESSION PUMP

This United States utility patent application claims priority on and the benefit of provisional application 63/413,195 filed Oct. 4, 2022, and also claims priority on and the benefit of provisional application 63/424,695 filed Nov. 11, 2022, the entire contents of both being hereby incorporated herein by reference.

BACKGROUND OF THE INVENTION

1. Field of the Invention

The present invention relates to a compression pump, and in particular to a compression pump that has a bladder that is supported on the low-pressure side during the compression stroke, and that can have a compression cavity that is fully evacuated during each stroke.

2. Description of the Related Art

There are many types of pumps. One such pump is a diaphragm pump. A standard diaphragm pump has a bladder that requires similar pressures on both sides of the bladder to prevent bulging of the bladder. Hence, a standard diaphragm pump would not work well with a large pressure differential on opposite sides of the bladder.

For example, in an application such as an air conditioning system, a system 1 using a refrigerant 2 is used. One example of a system 1 is illustrated in FIG. 98. The system 1 has a condenser 5, an expansion valve 7 with an inlet 8 and an outlet 9, an evaporator 11 and a compressor 15 with an inlet 16 and an outlet 17. The compressor 15 can operate with a high-pressure side of about 350 PSI and a low-pressure side of about 150 PSI when using R410a. In such an application, a standard diaphragm pump would not work. Instead, modem HVAC compressors often incorporate scroll, piston or rotary pumps. Yet, each of the known compression pumps requires oil to be mixed with the refrigerant in order to provide lubrication to the metal-on-metal parts of the pumps. Adding oil has some thermodynamic and conductivity disadvantages, including inability to change state like the refrigerant, and also leave a fine layer of oil on all interior parts of the system reducing conductive heat transfer. These drawbacks directly reduce pump efficiency, which in turn, increases energy consumed during operation.

Thus, there exists a need for a compression pump that solves these and other problems.

SUMMARY OF THE INVENTION

A compression pump has a bladder that is supported during the compression stroke on the low-pressure side of the bladder, and that can have a compression cavity that is fully evacuated during each stroke. The compression pump can have a housing with an entrance section, a center section, and a crown section. The entrance and center sections define seats to receive bridge bearings (of bridges each having a rod and a bearing). A piston can have an inlet section, a middle section, and a head section. The inlet and middle sections define seats to receive groove bearings. The bridges and groove bearings structurally hold a support structure, which supports the bladder. The support structure can be a slide support that changes shape as the piston moves within the housing. The piston head can have a valve seat that the inlet valve head is received within when it is closed.

There are many aspects of the present invention, which each can have unique and independent advantages, as set out in particular in the appended claims.

According to one advantage of the present invention, the compression pump has a compression cavity with a top and a bottom. The cavity bottom is defined by the bladder and the piston head section. The cavity top is defined by the housing crown section. The cavity volume switches between full (at piston bottom dead center, or "BDC") and fully evacuated (at piston top dead center, or "TDC").

According to another advantage of the present invention, the compression pump has a housing with a cylindrical interior portion that can accommodate and guide the piston as it moves between top dead center and bottom dead center.

According to a further advantage of the present invention, the housing can be constructed of three individual parts that lie in parallel planes and can be assembled in a stack forming an exterior body with interior side wall. The three parts are a housing entrance section (where a piston can enter), a housing center section and a housing crown section that acts as a cylinder head.

According to a still further advantage of the present invention, a bearing seat can be formed into the interior cylinder portion of the housing approximately midway between where the housing entrance section and housing center section join, referred to as the housing seat. As the ID of the housing entrance section is less than the ID of the housing middle section, the housing seat can act as a receptacle for a bridge bearing and can circumferentially span more than 180 degrees around the bridge bearing to encapsulate it and hold it in place.

According to a still further advantage yet of the present invention, there can be multiple housing seats around the inner circumference of the housing.

According to a still further advantage yet of the present invention, the bridge bearing can be rotatable within the housing seat as the piston moves upward and downward.

According to a still further advantage yet of the present invention, the piston can also be constructed of three individual parts that lie in parallel planes and can be assembled in a stack. The three parts are a piston inlet section (that can be connected to a crankshaft), a piston middle section, and a piston head section (that can accommodate an inlet valve).

According to a still further advantage yet of the present invention, a bearing seat can be formed into the exterior portion of the piston approximately midway between where the piston inlet section and piston middle section join together. The lower portion of the groove bearing seat is formed into the piston entrance relief. The upper portion of the groove bearing is formed into the bottom of the middle section. As such, the piston seat can act as a receptacle for a groove bearing and can circumferentially span more than 180 degrees around the groove bearing to encapsulate it and hold it in place.

According to a still further advantage yet of the present invention, the groove bearing can be rotatable within the piston seat as the piston reciprocates between TDC and BDC.

According to a still further advantage yet of the present invention, a sufficient recess can be provided around the piston seat to accommodate changing angles and bridge rod movement as the piston moves upward and downward and to receive the portion of the rod that extends past the groove bearing within the piston seat.

According to a still further advantage yet of the present invention, there can be multiple piston seats around the outer circumference of the piston.

According to an advantage of an alternative embodiment of the present invention, the position of the seats and bearings can be reversed without departing from all aspects of the present invention. In this regard, the groove bearing could be in a groove bearing seat formed in the housing, and the bridge bearing could be in a bridge bearing seat formed in the piston.

According to a still further advantage yet of the present invention, the number of housing seats can be equal the number of piston seats as they can then both accommodate equal numbers of bridge bearings and groove bearings, respectively. Further, the housing and piston seats could be equally spaced around the circumference of both the housing and piston, respectively. This will provide equal support for the support structure which drives the bladder.

According to a still further advantage yet of the present invention, the outside diameter, or "OD", of the piston inlet section could be slightly less than the inside diameter, or "ID", of the housing entrance section. As such, there will be piston clearance and the ID of the housing entrance section will act as a guide for the OD of the piston inlet section.

According to a still further advantage yet of the present invention, one or more pressure equalization passages can be provided, preferably around or through the piston inlet section, whereby the pressure in the support void can be equalized with a pressure on the outside of the piston inlet section.

According to a still further advantage yet of the present invention, the OD of both the piston middle section and the piston head section could be approximately ⅔ the ID of the housing center section and crown section. As such, there will be a portion of the bladder that spans between the piston and housing, that can remain flexible and stretchable as it is bound neither by the piston nor the housing.

According to a still further advantage yet of the present invention, both the housing center section and piston middle section will have a thickness. Further, there will be a distance between the piston middle section OD and the housing center section ID. The area of the (Thickness× Distance) will follow the entire 360-degree circumference of both the piston and housing. This defined volume is a support void and can accommodate a support structure.

According to a still further advantage yet of the present invention, the bladder can be flexible and separates the high-pressure and low-pressure sides of the pump.

According to a still further advantage yet of the present invention, the bladder can be squeezed between the housing center section and housing crown section when assembled. The bladder can lie in the same plane as both the housing center section and housing crown section and be perpendicular to the interior wall when the piston is midway between top dead center and bottom dead center.

According to a still further advantage yet of the present invention, the bladder can be squeezed between the piston middle section and piston head section when assembled. The bladder can lie in the same plane as both the piston middle section and piston head section and be perpendicular to the piston side wall when the piston is midway between top dead center and bottom dead center.

According to a still further advantage yet of the present invention, the bladder can be completely sealed and can be non-porous (sealed inner circumference between piston middle section and piston head section, and outer circumference between the housing center section and housing crown section). Having the bladder be completely sealed advantageously allows the pump to work at any RPM without leakage.

According to a still further advantage yet of the present invention, the bladder can be supported by a support structure on the low-pressure side of the bladder to prevent bulging of the bladder.

According to a still further advantage yet of the present invention, the support structure can be a slide support. Two examples of slide supports are coils and concentric rings. The slide support can provide smooth and shape-changing support to the bladder as the piston moves between top dead center and bottom dead center. The slide support can be conical at both top dead center and bottom dead center and can be flat at a point between top dead center and bottom dead center. This can advantageously be accomplished by having the outer perimeter of the slide support be in a fixed position with respect to the housing and the inner perimeter of the slide support move with the piston.

According to a still further advantage yet of the present invention, the slide support can be received within the support void, and is separated from the compression cavity by the bladder.

According to a still further advantage yet of the present invention, the supported bladder allows for a large pressure differential (between sides of the bladder). In one example there could be a high-pressure side (facing the interior of the compression cavity) exposed to a pressure of 350 PSI and a low-pressure side exposed to a pressure of 150 PSI. It is appreciated that the present invention is not limited to compressors with a high-pressure differential. There can be near equal pressures on both sides of the bladder.

According to a still further advantage of the present invention, a bridge can have a bearing that is seated in the housing seat and can rotate within the seat. The bridge bearing has a rod end that extends perpendicular from the circumference of the bearing and spans across the gap between the ID of the housing inside wall and the OD of the piston side wall and extends to and can be seated in the groove of the groove bearing. The top of the rod can be inward from tangent to and does extend from the hearing circumference. This allows the rod to clear the cylinder wall as the bearing rotates.

According to a still further advantage yet of the present invention, the fulcrum of the bridge bearing can be approximately colinear with the inner wall of the housing center section. As a result, a given movement of the piston will result in no or very little movement of the support and bladder at the housing interior wall.

According to a still further advantage of the present invention, the groove bearing can be seated in the piston seat and can rotate within the seat. The groove bearing can have a groove perpendicular to the circumference of the groove bearing that accepts and acts as a support for a rod portion of the bridge. Further, the groove in the groove bearing allows the rod to slide inward and outward through the groove as the piston moves between top dead center and bottom dead center.

According to a still further advantage yet of the present invention, the fulcrum of the groove bearing can be approximately colinear with the piston middle section outer wall. As a result, a given movement of the piston will translate into a near equal movement of both the slide support and bladder at the piston.

According to a still further advantage of the present invention, the bridge bearing can rotate but remains in a fixed location as the housing does not move. The groove bearing can rotate and remain in a fixed location within the piston. However, the groove bearing will move upward and downward with the piston with respect to the housing. The effective distance between the fulcrums of the bridge bearing and groove bearing changes as the piston moves.

According to a still further advantage yet of the present invention, the groove bearing seats each can have a recess to accommodate a portion of the rod that extends beyond the groove bearing as the piston moves between top dead center and bottom dead center. The maximum rod extension beyond the groove bearing occurs at the minimum effective length of the rod, at a midway point between top dead center and bottom dead center. The maximum rod effective length occurs at both top dead center and bottom dead center, where the distance between the bridge bearing fulcrum and the groove bearing fulcrum is at a maximum.

According to a still a further advantage of the present invention, the bridge bearing and groove bearing can rotate within the perimeter of the housing seat and piston seat respectively. This allows for the necessary angular change of both the rod and groove angles as the piston moves upward and downward allowing for full cooperation between the piston, housing, bridge, groove bearing, support structure and bladder.

According to a still further advantage of the present invention, the bridge rod will extend across the gap between the ID of the housing wall to the OD of the piston circumference and lie in the groove of the groove bearing. This connection of the bridge bearing and the groove bearing with the rod form a structural support between the housing and piston. The bridge and groove bearings cooperate with the housing and piston respectively, to drive the slide support during the intake and compression strokes while supporting the bladder.

According to a still further advantage yet of the present invention, the bridge rod extends perpendicular from the bridge bearing and has a diameter that is about ½ of the bridge bearing diameter. As such, one side of the rod can dissect the bearing at the bearing fulcrum thereby moving in near perfect unison with the bearing at the fulcrum point. The other side of the rod (180 degrees separated) can intersect the outer bearing surface near tangentially or at an angle to accommodate angular rod movement as the piston reciprocates. It is appreciated that the rod need not be tangent to the bridge bearing. Regardless, the extension of the rod from the bridge bearing allows for the rod to fully engage the bottom of the slide support. Further, this arrangement allows for sufficient structural support from the rod as it drives the slide support.

According to a still further advantage yet of the present invention, at least one bridge and groove bearing can support and drive the slide support. Yet, it is appreciated that at least two bridges and groove bearings are preferred for symmetry and superior slide support and bladder support.

According to a further advantage yet of the present invention, the groove in the groove bearing can be oriented towards the bladder. In this regard, the groove bearing cups the rod of the bridge and transfers driving force from the piston to the bridge (and to the slide support and ultimately to the bladder).

According to a still further advantage yet of the present invention, the slide support can fit comfortably into the support void, with one face of the slide support resting against the low-pressure side of the bladder and the opposite face resting against the rod portion of the bridge. The sides of the slide support would rest against both the housing center section and the piston middle section.

Related, each layer of the slide support (distinct ring or revolution of a coil) preferably can have a thin profile. It is appreciated that the thinner the individual layer, the smoother the support of the bladder.

According to a still further advantage of the present invention, the slide support can be tightly wrapped or packed with side-to-side support of adjacent layers to prevent inward and outward bending of the individual layers.

According to a still further advantage yet of the present invention, each layer can be tall in comparison to its respective width. This advantageously greatly increases the slide support's resistance to deflection in directions parallel to the height or vertical dimension of the support.

According to a still further advantage of an embodiment of the present invention, the slide support can be comprised of two or more distinct elements. For example, a low friction element could be paired with a metal element wherein there is very little friction between adjacent layers.

According to a still further advantage yet of the present invention, the support structure allows for use of a thin, stretchable and conformable bladder. Further, having a thin, stretchable and conformable bladder allows the bladder to stretch and conform to the tops of the support structure layers, thereby eliminating friction.

According to a still further advantage yet of the present invention, since the bladder is supported by the slide support, it similarly has a section within the cavity that moves between conical and flat as the piston moves between top dead center and bottom dead center. The volume of the cavity is defined by the piston head section, the bladder and the housing crown.

According to a still further advantage yet of the present invention, the piston can have inlet ports cut through the piston inlet section, piston middle section, bladder and piston head section allowing a working fluid to enter the compression cavity. An inlet valve is seated in the seat of the piston head section. As such, the valve head distal end is in the same plane as the piston head section distal face. Therefore, there is no gap between the housing and piston at top dead center resulting in full evacuation of the working medium such as a gas refrigerant, other gas, or even a liquid.

According to an advantage of an alternative embodiment of the present invention, the inlet can be formed through the housing instead of the piston.

According to a still further advantage yet of the present invention, the housing crown section can have a rigid base with a central exhaust port. The profiles of the cavity top and cavity bottom mate to allow for complete evacuation at top dead center. Also, at top dead center, the piston head distal face, the valve head distal end, the housing crown exterior face and the exhaust valve interior face can all be in the same plane, allowing the compression cavity to fully evacuate.

According to a still further advantage yet of the present invention, the benefits of supporting the bladder with a support structure are realized regardless of whether the inlet valve is through the piston or the housing.

According to a still further advantage yet of the present invention, the inlet valve can be slightly biased towards the closed position. The bias is easy to overcome during the intake stroke.

According to a still further advantage yet of the present invention, the exhaust valve can be slightly biased towards the closed position and the valve head distal end is in the same plane as the housing crown exterior face. The bias is easy to overcome during the exhaust stroke.

According to a still further advantage of the present invention, the compression cavity preferably has no metal-on-metal contact points, wherein lubricants are unnecessary for pump operation.

According to a still further advantage of the present invention, the working fluid could be a refrigerant without oil additives as high friction points are eliminated. Elimination of oil being mixed with the refrigerant results in a higher Coefficient of Performance ('COP') and reduces the amount of work the system uses per unit of refrigerant in the system.

According to a still further advantage yet of the present invention, multiple compression pumps can be used together forming an assembly that is operable with an offset shaft.

According to a still further advantage yet of the present invention, four crank arms can be provided for each compression pump to keep the piston parallel with respect to the housing.

According to a still further advantage of the present invention, while the pump is shown as a compression pump for air conditioning, it could be used as a heat pump or for other pumping operations without departing from the broad aspects of the present invention.

Other advantages, benefits, and features of the present invention will become apparent to those skilled in the art upon reading the detailed description of the invention and studying the drawings.

BRIEF DESCRIPTION OF THE DRAWINGS

FIG. 12 is a top isolation view of a housing entrance section.

FIG. 13 is a perspective view of the housing entrance section.

FIG. 93 is a perspective view showing two mounting plates connected to the compression pump.

FIG. 94 is a side view of a compression pump assembly.

FIG. 95 is a perspective view of the compression pump assembly shown in FIG. 94.

FIG. 96 is an end view of the compression pump assembly shown in FIG. 94.

FIG. 103 is a side view of the crown section shown in FIG. 102.

DETAILED DESCRIPTION OF PREFERRED EMBODIMENTS

Figure 1:
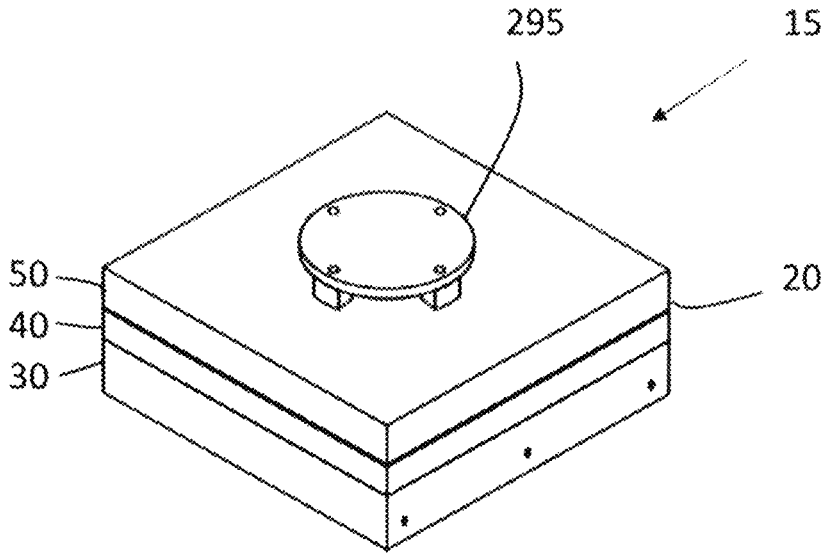
FIG. 1 is an upper perspective view of a compression pump of the present invention.
Figure 2:
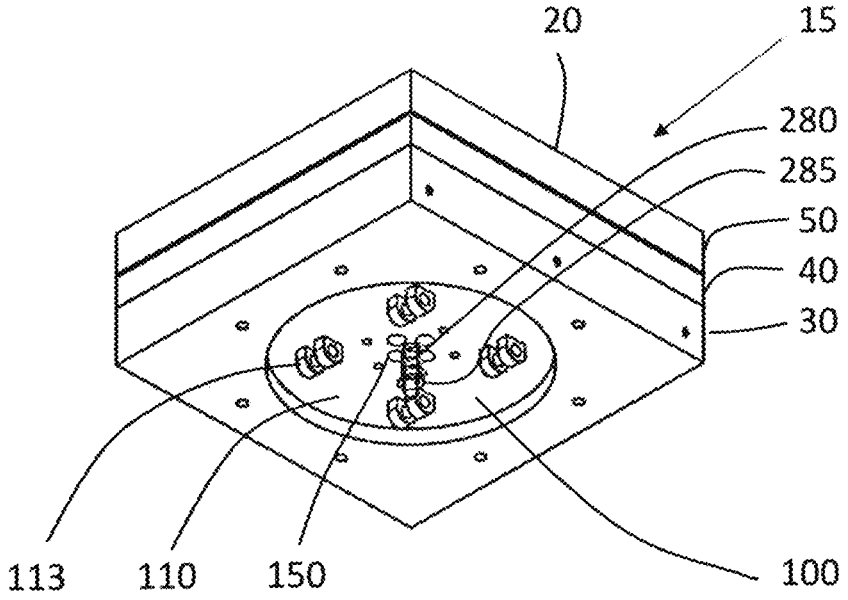
FIG. 2 is a lower perspective view of the compression pump illustrated in FIG. 1.
Figure 3:
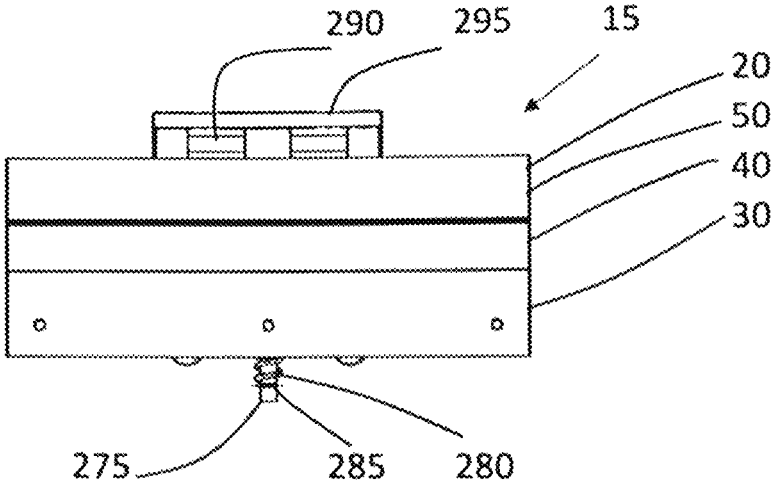
FIG. 3 is a side view of the compression pump illustrated in FIG. 1.
Figure 4:
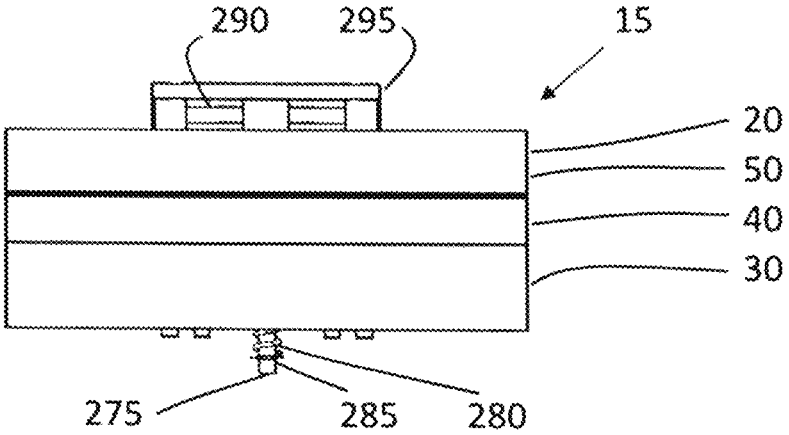
FIG. 4 is a side view of the compression pump illustrated in FIG. 1.
Figure 5:
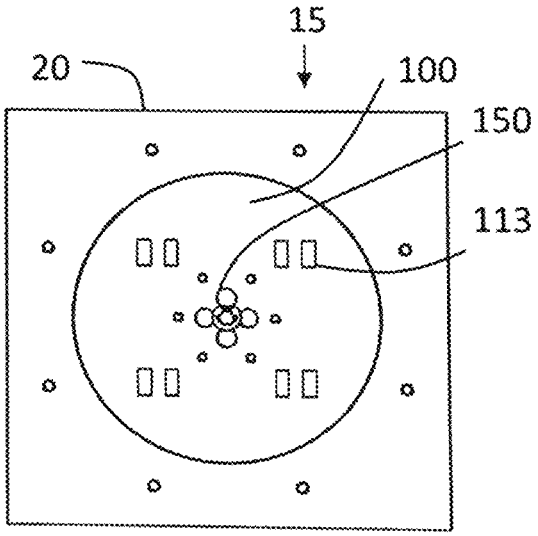
FIG. 5 is a bottom view of the compression pump illustrated in FIG. 1.
Figure 6:
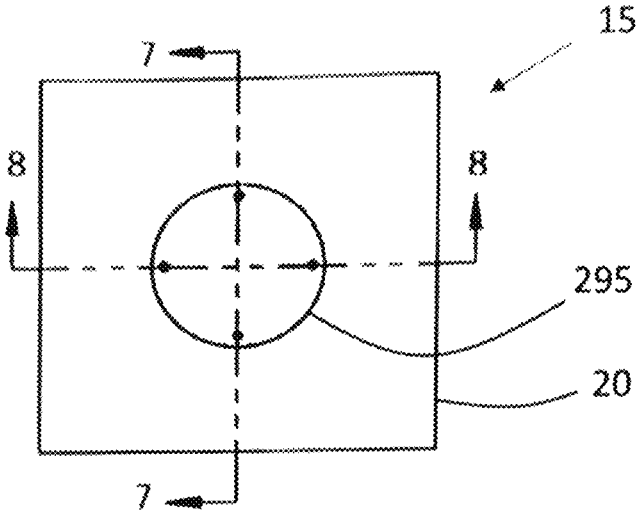
FIG. 6 is a top view of the compression pump illustrated in FIG. 1.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

A compression pump 15 is seen generally in FIGS. 1-11, as well as in other figures. An embodiment of compression pump 15 has a housing 20, a piston 100, a support void 180 separated from a compression cavity 190 by a bladder 200, a support structure 210, a bridge 230, a groove bearing 260, an inlet valve 270 and an exhaust valve 290. Each of these parts are describe below.

The housing 20 has an entrance section 30, as seen in isolation in FIGS. 12-15. The entrance section 30, or just entrance, has an inner wall 31 and a portion 60A of housing seat 60. The inner wall 31 is cylindrical and has in inside diameter ("ID"). The housing 20 further has a center section 40, as seen in isolation in FIGS. 16-19. The center section 40, or just center, has an inner wall 41 and a portion 60B of housing seat 60. The housing 20 further has a crown section 50, or just crown, as seen in isolation in FIGS. 20-23. The crown section 50 has an outer wall 51, a middle wall 52, an interior face 53, an inner wall 54, an outlet 55 and an exterior face 56.

The entrance section 30, center section 40 and crown section 50 are stacked together in parallel planes, and are held together with bolts, screws or other fasteners. Housing seats 60 are formed between the entrance section 30 and the middle section 40. The housing seats face towards the inside of the housing cavity. The housing seats 60 preferably radially span greater than 180 degrees.

The piston 100 has an inlet section 110, as seen in isolation in FIGS. 24-27. The inlet section 110, or just inlet, has on outer wall 111. A first portion of the outer wall is cylindrical. A second portion of the outer wall is angled (forming a relief 112), wherein the interior portion of the outer wall has a conical frustum shape. A portion 140A of piston seat 140 is formed into the relief 112. There are preferably four sets of lugs 113 on the base of the inlet section. The inlet section preferably has one or more pressure equalization passages 115. In the illustrated embodiment, the pressure equalization passages 115 are scallop shaped indents formed in the outer perimeter of the first portion of the outer wall. It is appreciated that any number of passages can be used. It is further understood that other structures, such as passages passing through the inlet section 110 between the inlet section outer face and the inlet section relief 112 could be alternatively used. The piston 100 further has a middle section 120 as seen in isolation in FIGS. 28-31. The middle section 120, or just middle, has an outer wall 121 and a portion 140B of piston seat 140. The piston 100 further has a head section 130, as seen in isolation in FIGS. 32-35. The head section, 130, or just head, has an outer wall 131, an inner face 132, an inner wall 133, a distal face 134 and a valve seat 135. The valve seat 135 has a sidewall 136 and a base 137.

The inlet section 110, middle section 120 and head section 130 are stacked together in parallel planes, and are held together with bolts, screws or other fasteners. Piston seats 140 are formed between the inlet section 110 and middle section 120. The piston seats face towards the outside of the piston 100. The piston seats 140 preferably radially span greater than 180 degrees. Each piston seat 140 has a recess 141, which is preferably a radial groove in the middle of the outer seat sidewall.

It is appreciated that there can be multiple housing seats 60 and piston seats 140 spaced radially about the housing interior and piston exterior, respectively. It is preferred that there are equal numbers of housing seats 60 and piston seats 140, and that they are equally spaced from each other. In a preferred embodiment, there are eight housing seats 60 and eight piston seats 140. However, it is understood that there could be more or fewer, or that spacing could be altered, without departing from the broad aspects of the present invention.

Figure 97:
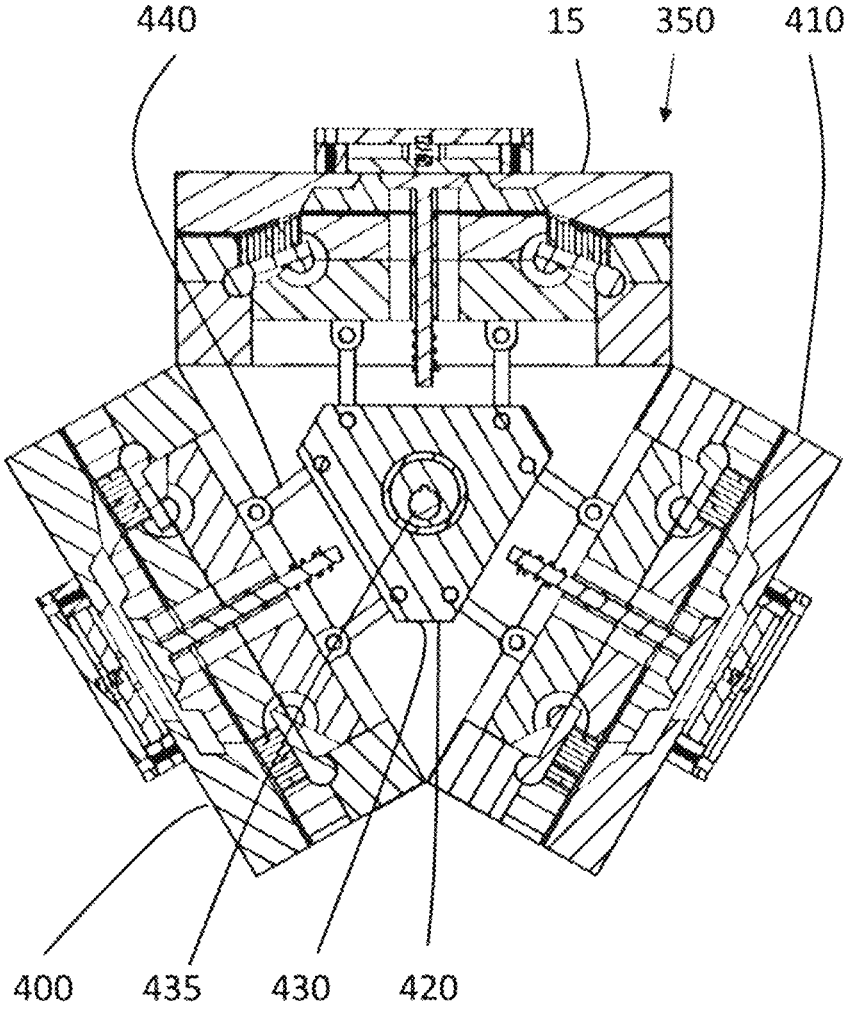
FIG. 97 is a cross-sectional view taken along line 97-97 in FIG. 96.

The piston 100 operates within the housing 20. Specifically, the piston 100 linearly moves between bottom dead center ("BDC") and top dead center ("TDC") within the housing 20. The inner wall 31 of the entrance section 30 is cylindrical and guides the cylindrical outer wall 111 of the inlet section 110 in a linear manner. The piston is connected to piston arms 440 and a drive assembly (crank), as seen in FIG. 97. Two sets of parallel crank arms (four crank arms), and the guidance from the cylindrical relationship of the housing and piston, results in linear movement without binding between the housing and piston.

The piston 100 has at least one inlet port 150 passing through the inlet section 110, the middle section 120 and the head section 130. The port 150 also passes through the bladder 200. In a preferred embodiment, there are four inlet ports spaced equally about a piston center axis. The inlet ports 150 allow a medium, such as a refrigerant gas, to pass from the outside of the inlet section 110, through the piston in a direction parallel to the piston axis, and into a compression cavity 190, described below, during an intake stroke. It is appreciated that there could be more or fewer ports without departing from the broad aspects of the present invention. There is a valve stem cavity that is aligned parallel with the inlet ports 150 preferably through the center of the piston 100.

Figure 47:
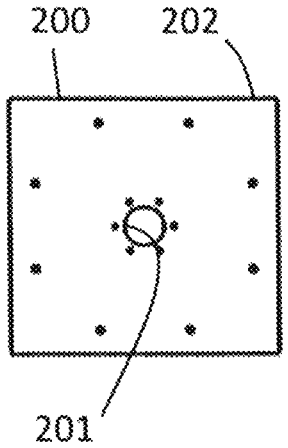
FIG. 47 is a top isolation view of a bladder.
Figure 48:
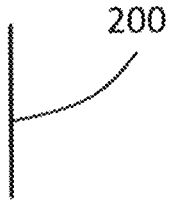
FIG. 48 is a side view of the bladder.

Turning now to FIGS. 47-48, it is seen that a preferred embodiment of a bladder 200 is illustrated. The bladder 200 is preferably made of a flexible, stretchable, and non-porous material, such as rubber. The bladder 200 has an inner perimeter 201, an outer perimeter 202, a first side 203 and a second side 204. There are inner perimeter holes and outer perimeter holes, as well as a central hole through the bladder 200.

The bladder outer perimeter 202 is held in place between the housing center section 40 and housing crown section 50. The bladder inner perimeter 201 is held in place between the piston middle section 120 and head section 130. The bladder 200 separates the support void 180 from the compression cavity 190. The bladder 200 forms a flexible and complete seal between the support void 180 and the compression cavity 190.

The support void spans between the housing center section 40 inner wall and the piston middle section 120 outer wall 360 degrees around the piston middle section outer wall and 360 degrees within the housing center section inner wall circumference.

The compression cavity 190 is bound by the inner portion of the crown section 50 and the outer portion of the piston head section 130. The compression cavity is also bound by the bladder 200 spanning between the housing 20 and piston 100. At bottom dead center, the compression cavity 190 has a preferred volume of 15.3 cubic inches in one embodiment. Yet, it is appreciated that the volume could be greater or less than this volume without departing from the broad aspects of the present invention. At top dead center, there is full evacuation of the compression cavity 190 (i.e., no volume remaining in the compression cavity). The top of the piston head section 130 mates with the bottom of the housing crown section 50 at TDC.

It is appreciated that at top dead center, that the piston top could stop short of contact with the crown in an alternative embodiment of the present invention if it were desired to have near full evacuation instead of full evacuation of the cavity.

It is appreciated that a support structure 210 is preferably located in the support void 180. The support structure 210 supports the low-pressure side 204 of the bladder. The support structure prevents the bladder from bulging under the high pressure on the high-pressure side of the bladder 200 within the compression cavity 190. The pressure equalization passages 115 allows the pressure within the support void 180 to remain constant as the piston 100 moves with respect to the housing 20.

Figure 45:
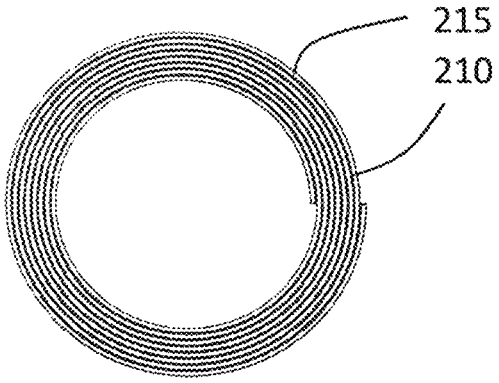
FIG. 45 is a top view of an alternative embodiment of a slide support.
Figure 46:
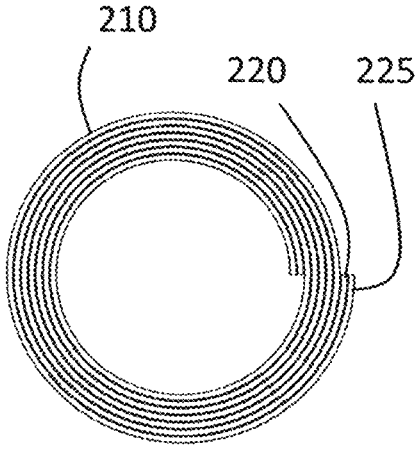
FIG. 46 is a top view of an alternative embodiment of a slide support.

In a preferred embodiment, the support structure 210 is a slide support. An example of a slide support 210 is made of a series of concentric rings 225, as seen in FIGS. 40-44. In another embodiment, the slide support 210 can be a slide coil (or just coil) 215, as seen in FIG. 45, made of several revolutions of a single piece of material. It is appreciated that other types of support structures (slide supports or otherwise) could be used. The slide support 210 is preferably made of metal and is comprised of several laterally positioned or wrapped layers. The material is preferably tall and thin. Each layer is able to slide relative to the adjacent layer. Each layer has a large height to width ratio, allowing the slide support 210 to have a large bending stiffness in the direction parallel to the direction of the piston axis of operation. The slide support 210 preferably has enough layers to fill the support void 180 from side to side, in order to fully support the bladder between the housing 20 and piston 100.

The slide support 210 is preferably cone shaped at both top dead center and bottom dead center. This occurs as the inside perimeter of the slide support 210 is in a fixed position with respect to the piston 100 and the outside perimeter of the support 210 is in a fixed position with respect to the housing 20. As the piston 100 moves within the housing 20, the shape of the slide support 210 changes. The slide support is flat when the piston 100 is between top and bottom dead center. The steepness of the slide support increases to maximum steepness at both top and bottom dead centers.

It is appreciated that the slide support 210 can be comprised of layers having different material properties. For example, adjacent rings 225 could alternate between steel and low friction materials. Alternatively, a second coil 220, which is a low friction coil, can be wrapped with coil 215 whereby the layers alternate between steel and low friction material. This would reduce friction in the support structure 210 thereby reducing energy consumption required for pump operation and eliminate the need for lubrication between layers while adding structural strength.

It is appreciated that each layer preferably touches or nearly touches adjacent layers side to side. One preferred layer thickness is between about 0.030 to 0.060 inch thick, and approximately 0.5 inch tall. It is understood that these dimensions can differ without departing from the broad aspects of the present invention. It is further understood that, for clarity of illustration, the figures show the support structure out of scale and sometimes with a small gap between layers in order to show the concept of how a slide support operates without an excessive number of lines (at 0.040 inch thickness, there would be about 23-25 layers needed to be shown to fill a 1 inch wide support void, including clearance, to prevent binding even with thermal expansion and contraction).

Figure 36:
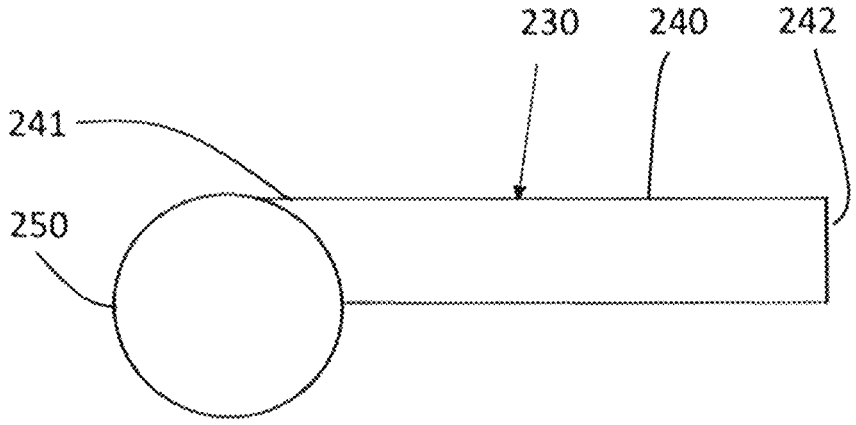
FIG. 36 is a side isolation view of a bridge.
Figure 37:
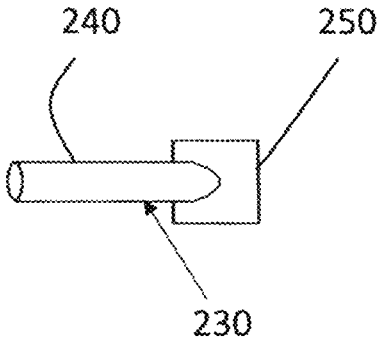
FIG. 37 is a top view of the bridge.
Figure 38:
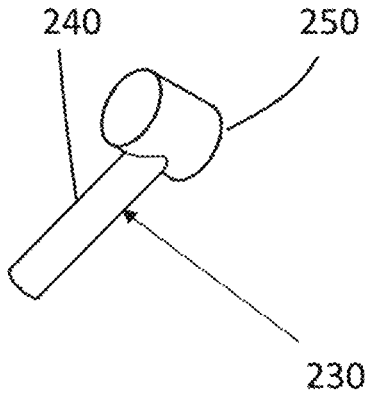
FIG. 38 is a perspective view of the bridge.

Turning now to FIGS. 36-38, it is seen that a preferred embodiment of a bridge 230 is illustrated. The bridge 230 has a rod 240 with ends 241 and 242, respectively. A bridge bearing 250 is at end 241 of the rod 240. The rod 240 on one side extends perpendicular from the circumference of the bridge bearing 250. The other side of rod 240 (180 degrees separated) is close to, and nearly tangential to, the bridge bearing 250. This arrangement allows for rod clearance from the housing interior wall at TDC. The rod 240 has a rod diameter, and the bridge bearing has a bridge bearing diameter. The rod diameter is approximately H of the bridge bearing diameter. The rod diameter is preferably slightly smaller than H of the bridge bearing diameter.

Figure 39:
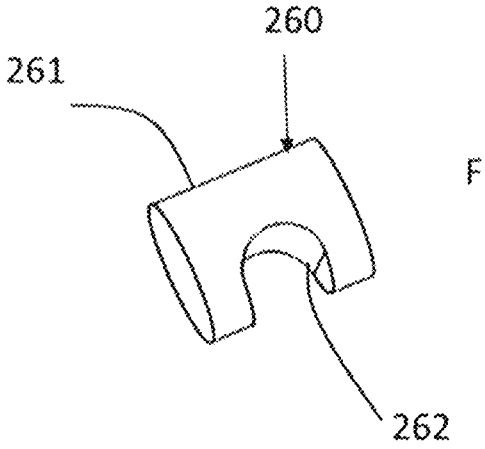
FIG. 39 is a perspective isolation view of a groove bearing.
Figure 40:
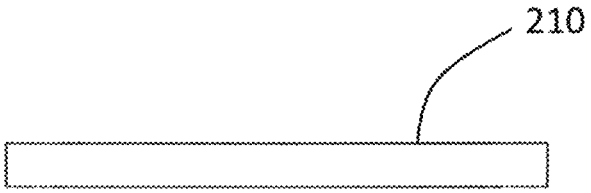
FIG. 40 is a side isolation view of an embodiment of a slide support.
Figure 41:
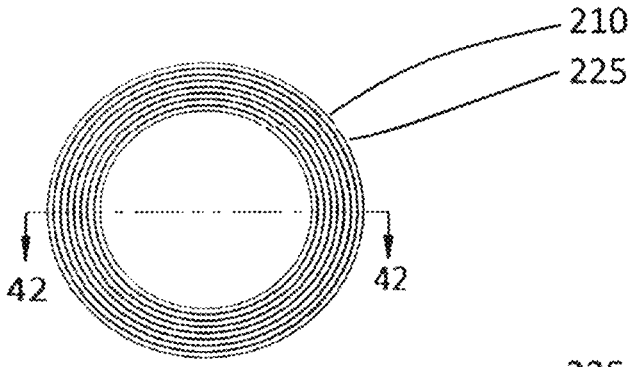
FIG. 41 is a top view of the slide support shown in FIG. 40.
Figure 42:
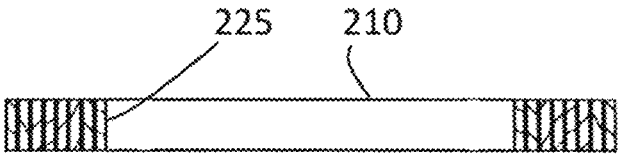
FIG. 42 is a cross-sectional view taken along line 42-42 in FIG. 41.
Figure 43:
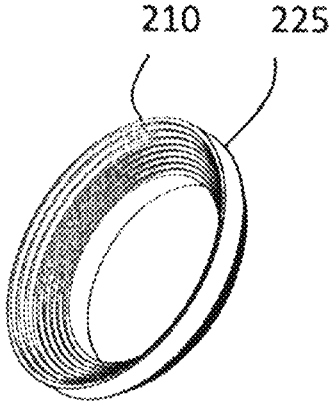
FIG. 43 is a perspective view of the slide support shown in FIG. 40.
Figure 44:
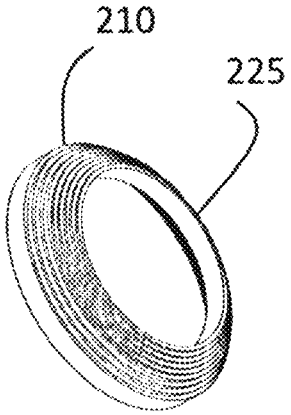
FIG. 44 is a perspective view of the slide support shown in FIG. 40.

A preferred embodiment of a groove bearing 260 is shown in isolation in FIG. 39. The groove bearing 260 has a body 261 with a groove 262 formed therein. The groove 262 is preferably round and has a diameter that is slightly larger than the rod diameter.

The bridge 230, groove bearing 260, housing 20 and piston 100 operate together to drive the slide support 210 to support and move the bladder 200.

The bridge bearing 250 is rotatably received within the housing seat 60. The fulcrum of the bridge bearing 250 is preferably generally aligned with the inner wall 41 of the housing center section 40. The rod 240 extends from a top portion of the bridge bearing (when viewed in the figures) to be positioned so as to support the slide support.

The groove bearing 260 is rotatably received within the piston seat 140. The fulcrum of the groove bearing 260 is preferably generally aligned with the outer wall 121 of the piston middle section 120. The groove 262 of the groove bearing 260 is open towards the bladder 200.

It is appreciated that the bridge bearing 250 remains in a fixed position (regardless of rotation) with respect to the housing 20, and that the groove bearing 260 remains in a fixed position (regardless of rotation) with respect to the piston 100. The rod 240 can be received within the groove 262 of the groove bearing 260, preferably in a cupping engagement. The rod 240 spans the gap between the housing 20 and piston 100. The effective length of the rod 240, i.e., the length of the rod between the bridge bearing fulcrum and groove bearing fulcrum, changes as the piston 100 moves with respect to the housing 20 and the rod 240 slides with respect to the groove bearing 260 within the groove 262. The effective length is largest at TDC and BDC. The effective length is shortest midway between TDC and BDC (when the slide support is flat).

The distal end 242 of the rod 240 preferably extends beyond the groove 262 of the groove bearing 260 at all rotational orientations between TDC and BDC, with a maximum extension midway between TDC and BDC. The distal end 242 of the rod 240 is received within the piston seat recess 141.

The bridge 230, housing 20 and piston 100 are designed so that the bridge rod 240 can move unobstructed as the piston moves. The rod 240 at BDC approaches the inner wall 31 of the entrance section. The rod 240 at TDC approaches the inner wall 41 of the center section 40. The relief 112 in the outer wall 111 of the inlet section 110 provides clearance for the bottom of the rod 240 when the piston 100 is at TDC.

The bladder 200, being supported by the slide support 210, deforms to assume that profile or shape of the slide support as it is in direct contact with the slide support.

Figure 7:
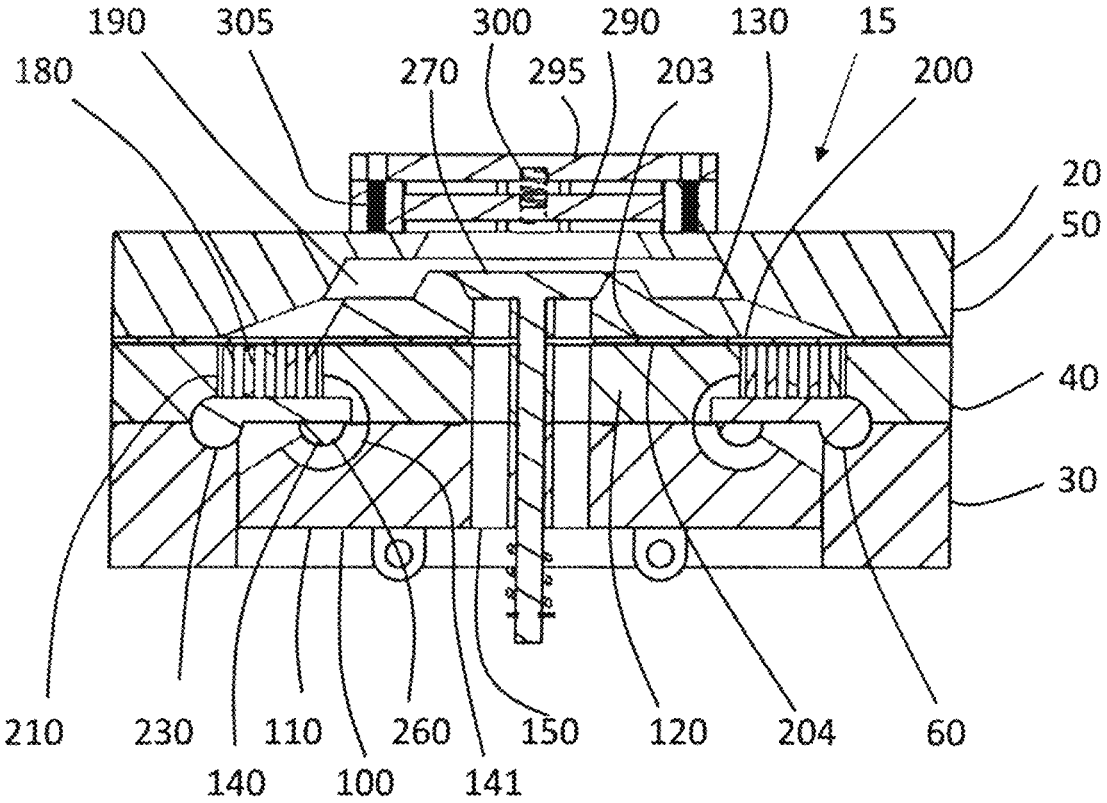
FIG. 7 is a cross-sectional view taken along line 7-7 in FIG. 6.
Figure 8:
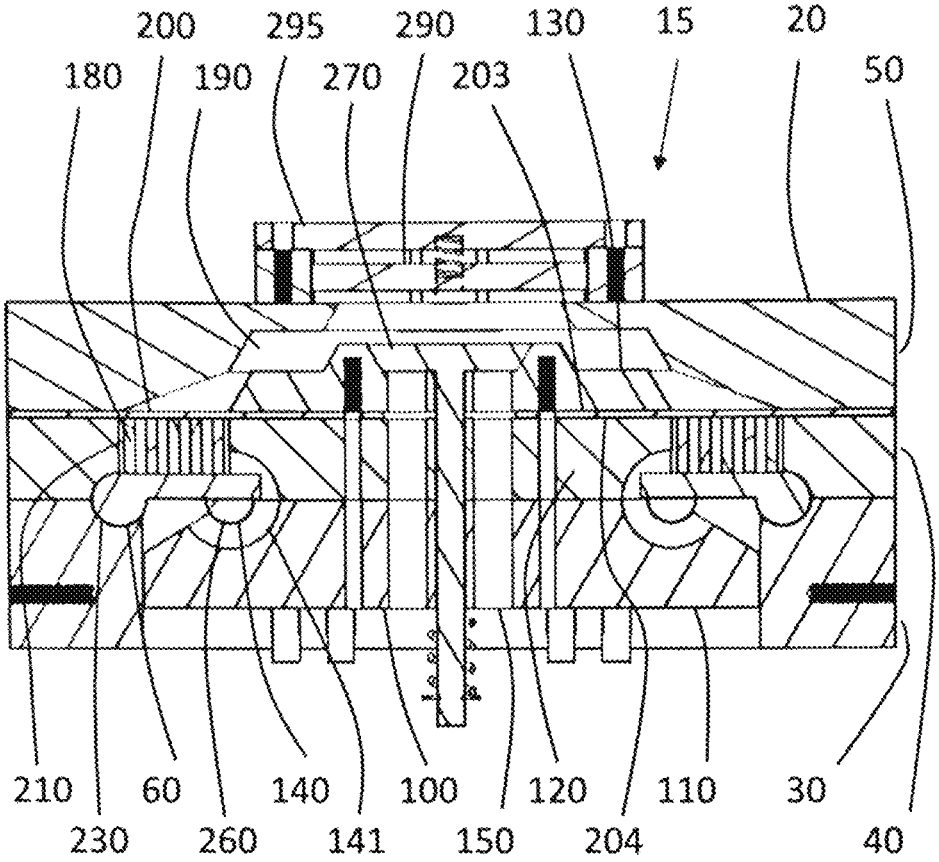
FIG. 8 is a cross-sectional view taken along line 8-8 in FIG. 6.
Figure 9:
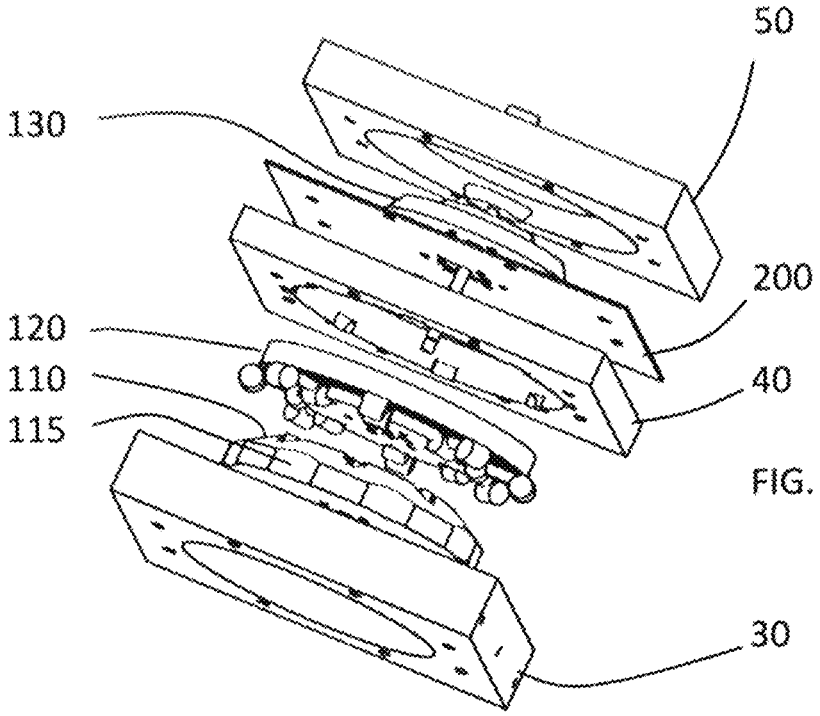
FIG. 9 is an exploded view of the compression pump illustrated in FIG. 1.
Figure 10:
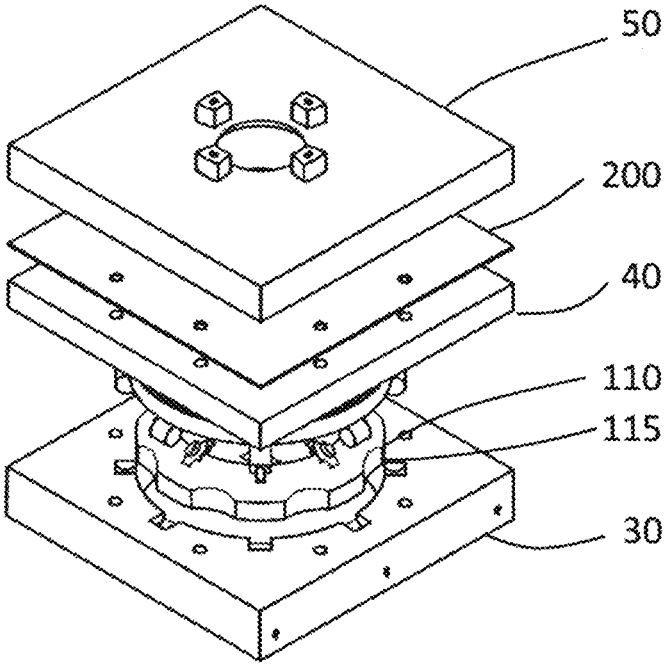
FIG. 10 is an exploded view of the compression pump illustrated in FIG. 1.
Figure 11:
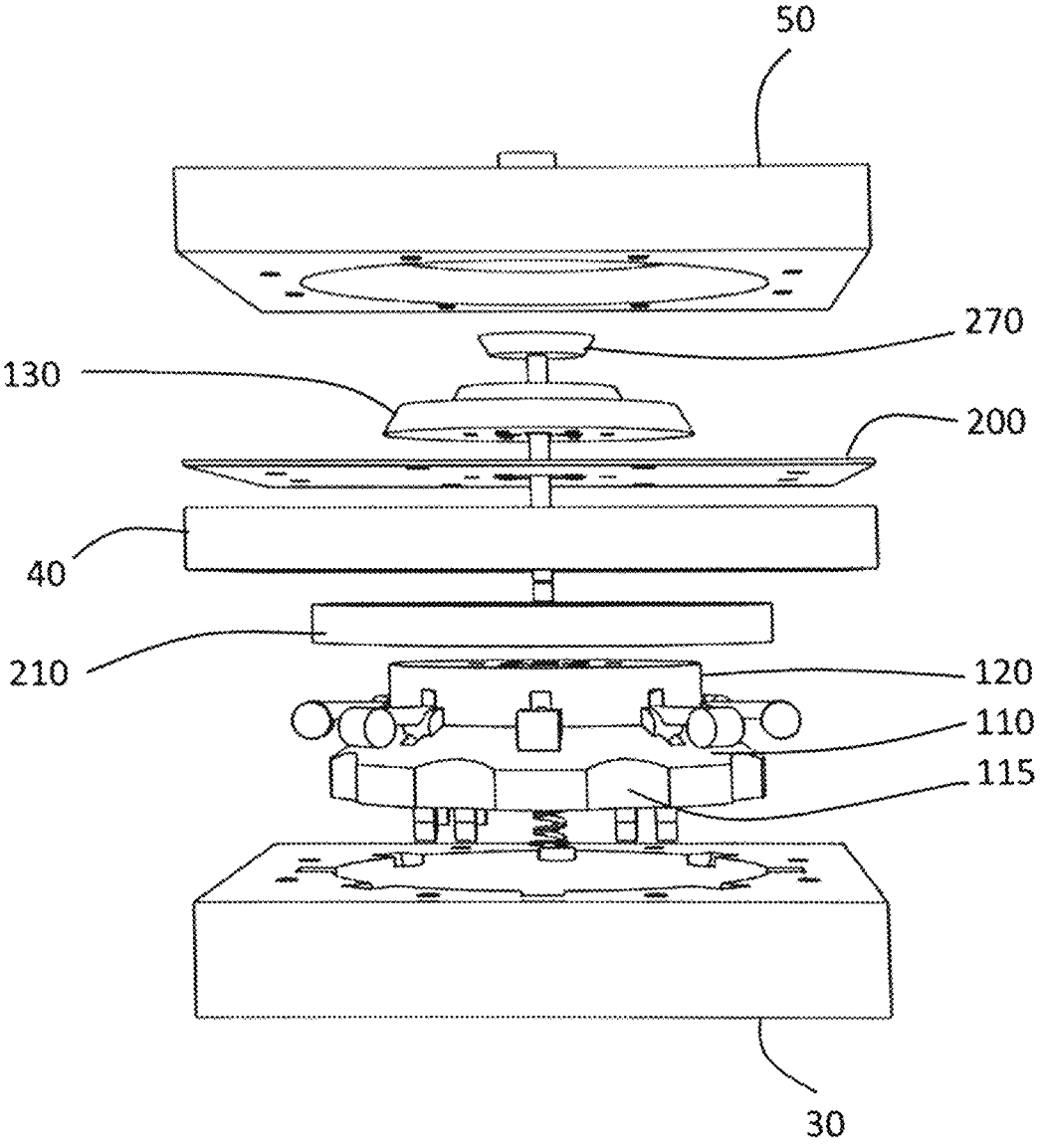
FIG. 11 is a perspective exploded view of the compression pump illustrated in FIG. 1.
Figure 14:
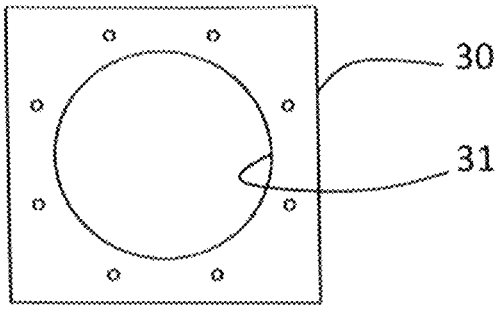
FIG. 14 is a bottom view of the housing entrance section.
Figure 15:
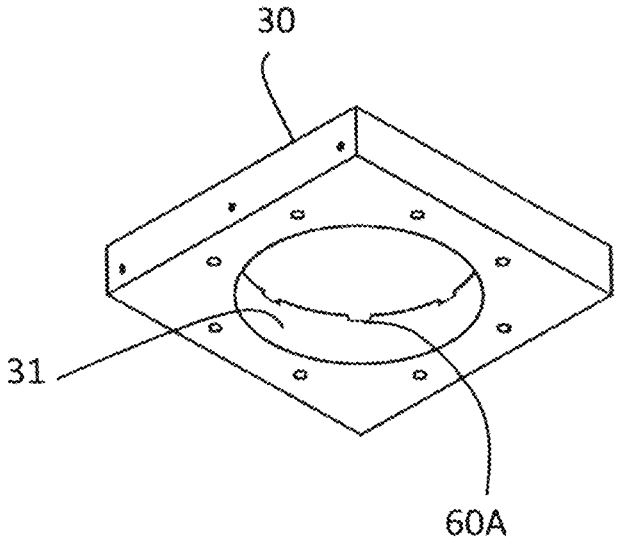
FIG. 15 is a lower perspective view of the housing entrance section.
Figure 16:
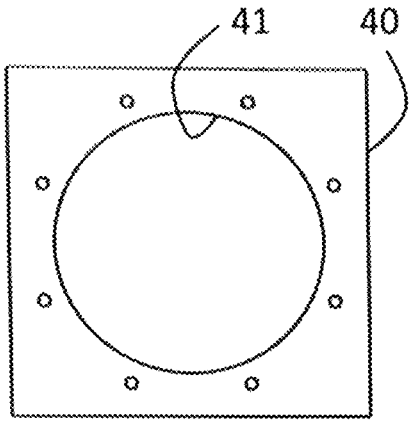
FIG. 16 is a top isolation view of a housing center section.
Figure 17:
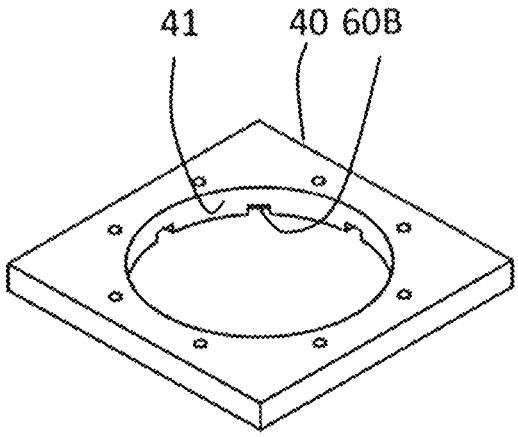
FIG. 17 is a perspective view of the housing center section.
Figure 18:
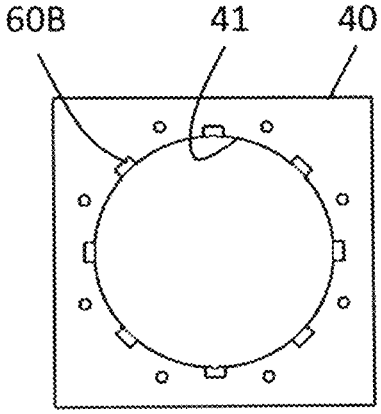
FIG. 18 is a bottom view of the housing center section.
Figure 19:
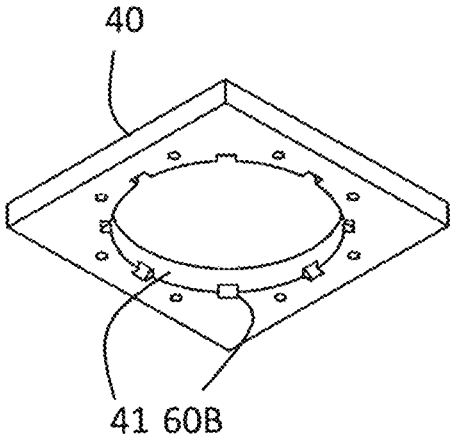
FIG. 19 is a lower perspective view of the housing center section.
Figure 20:
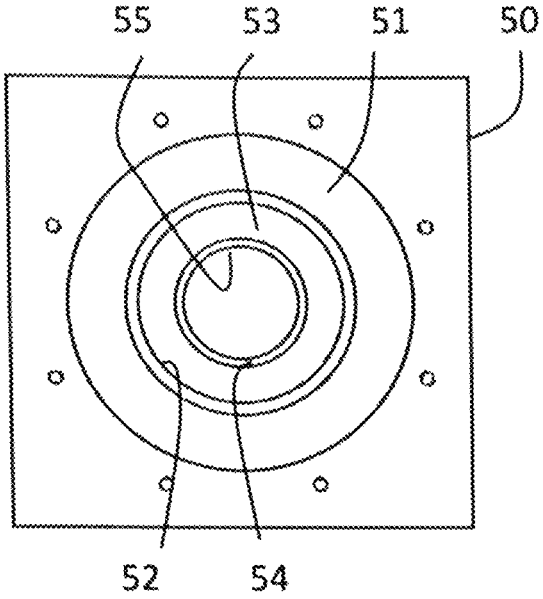
FIG. 20 is a bottom isolation view of a housing crown section.
Figure 21:
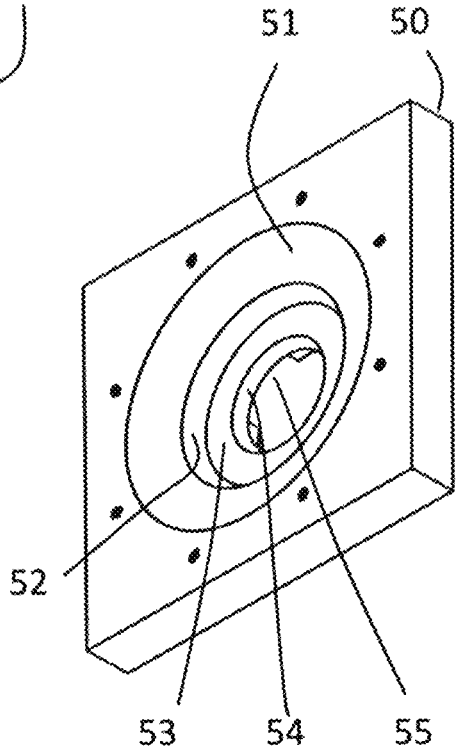
FIG. 21 is a perspective view of the housing crown section.
Figure 22:
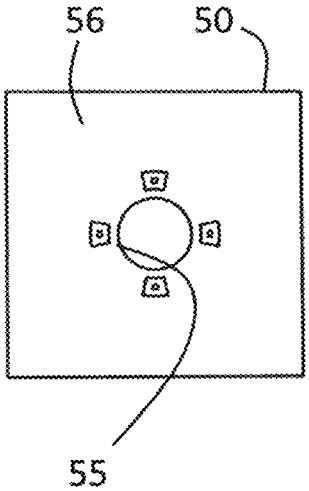
FIG. 22 is a top view of the housing crown section.
Figure 23:
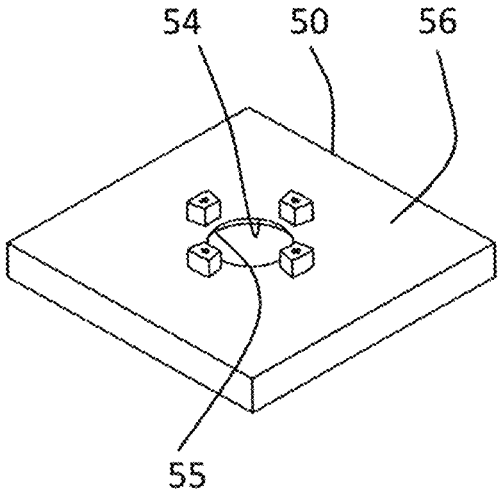
FIG. 23 is a perspective view of the housing crown section.
Figure 24:
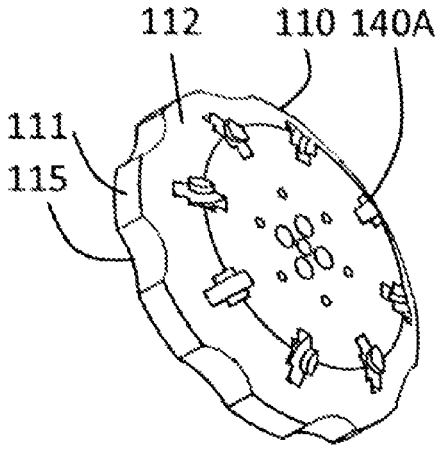
FIG. 24 is a perspective isolation view of a piston inlet section.
Figure 25:
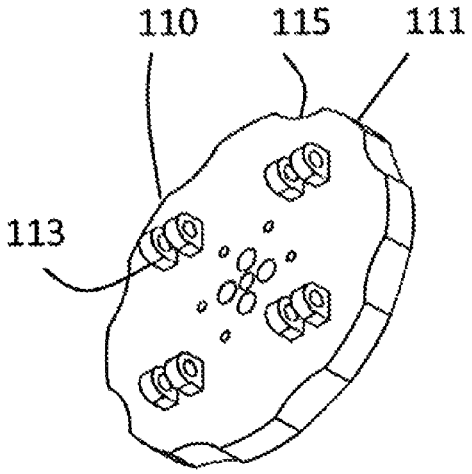
FIG. 25 is a lower perspective view of the piston inlet section.
Figure 26:
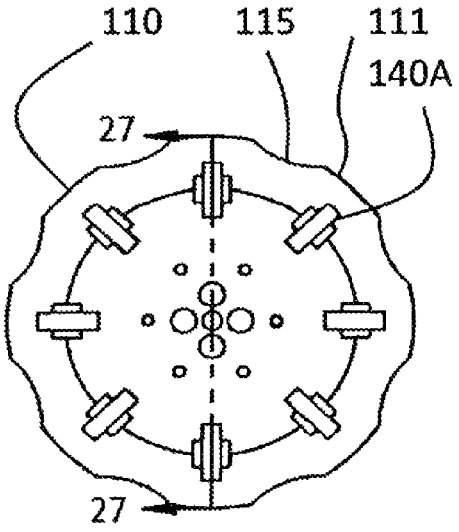
FIG. 26 is a top view of the piston inlet section.
Figure 27:
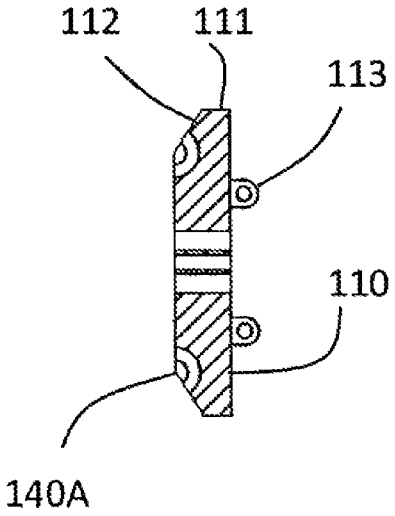
FIG. 27 is a cross-sectional view taken along line 27-27 in FIG. 26.
Figure 28:
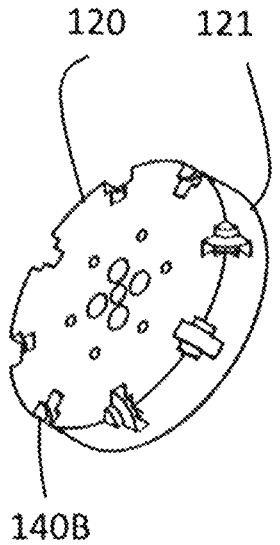
FIG. 28 is a perspective isolation view of a piston middle section.
Figure 29:
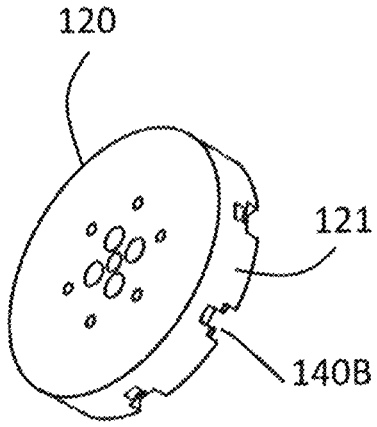
FIG. 29 is an alternative perspective view of the piston middle section.
Figure 30:
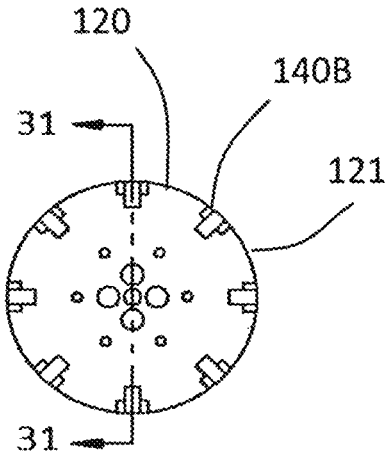
FIG. 30 is a bottom view of the piston middle section.
Figure 31:
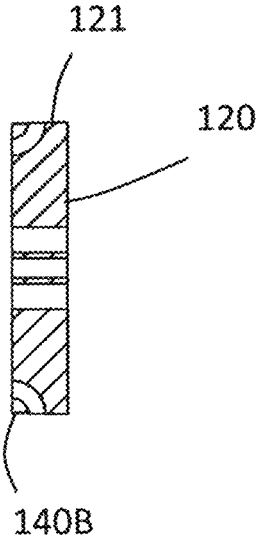
FIG. 31 is a cross-sectional view taken along line 31-31 in FIG. 30.
Figure 32:
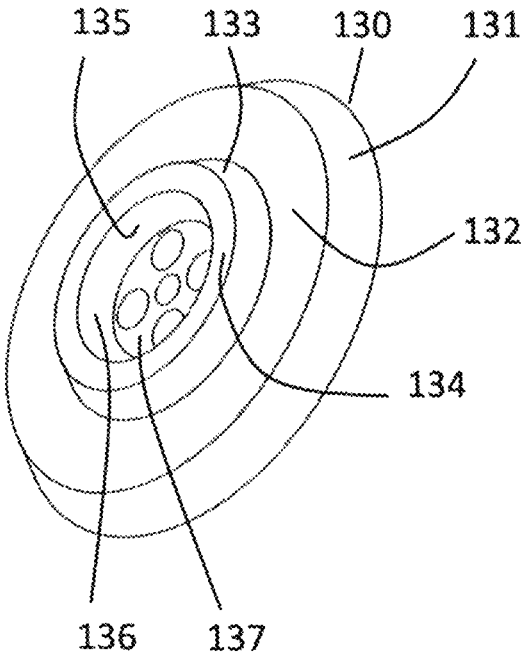
FIG. 32 is a perspective isolation view of a piston head section.
Figure 33:
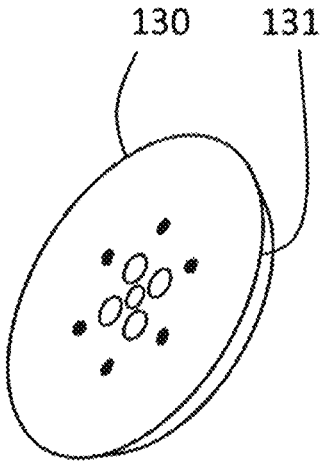
FIG. 33 is an alternative perspective view of the piston head section.
Figure 34:
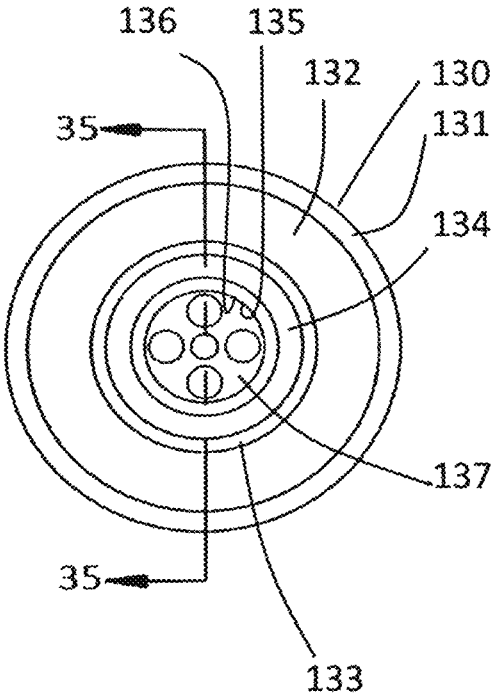
FIG. 34 is a top view of the piston head section.
Figure 35:
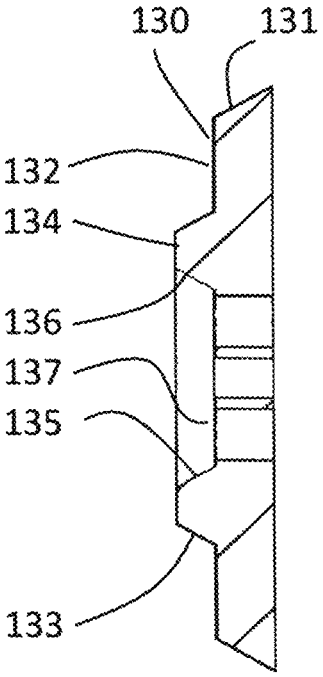
FIG. 35 is a cross-sectional view taken along line 35-35 in FIG. 34.
Figure 49:
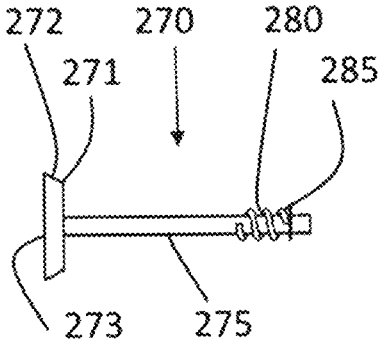
FIG. 49 is a side view of an inlet valve.
Figure 50:
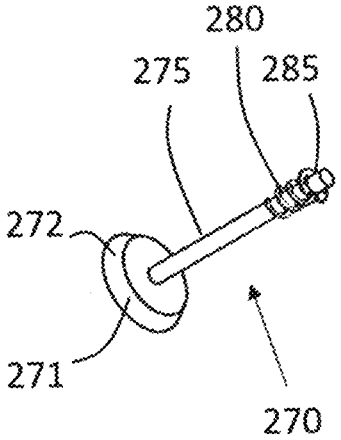
FIG. 50 is a perspective view of the inlet valve.
Figure 51:
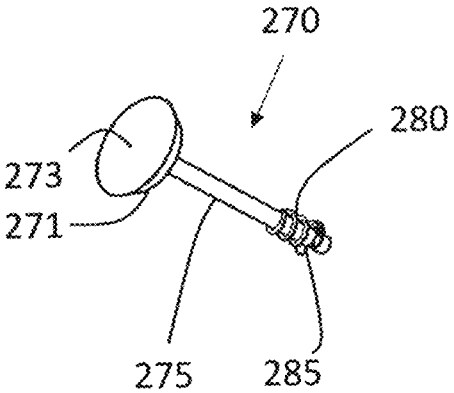
FIG. 51 is an alternative view of the inlet valve.

Turning now to FIGS. 49-51, it is seen that a preferred embodiment of an inlet valve 270 is illustrated in isolation. The inlet valve 270 can also be called a piston valve in embodiments where the inlet valve passes through the piston. The inlet valve 270 has a head 271 having a valve face 272 and a distal end 273. A stem 275 is also provided, as is an inlet valve spring 280 and a piston retaining ring 285. The head 271 sits within the valve seat 135 when the inlet valve is closed, as seen in FIG. 7. In the closed position, the head distal end 273 is preferably flush with the piston head section face 134. The inlet valve 270 is biased closed by the inlet valve spring 280. The inlet valve head 271 covers the inner ends of inlet ports 150 when the valve 270 is closed, preventing fluid communication into the compression cavity 190. There are four ports in the preferred embodiment that are covered by the inlet valve when the inlet valve is closed.

Figure 52:
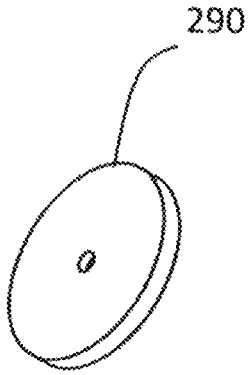
FIG. 52 is a perspective isolation view of an exhaust valve.
Figure 53:
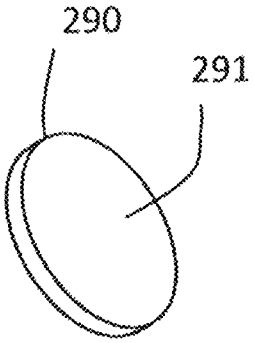
FIG. 53 is a perspective view of the exhaust valve.
Figure 54:
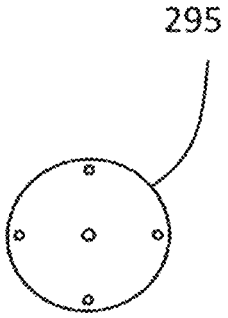
FIG. 54 is an interior isolation view of an exhaust valve cover.
Figure 55:
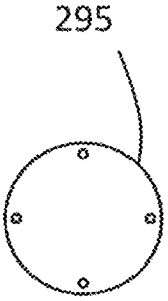
FIG. 55 is an exterior view of the exhaust valve cover.

An exhaust valve 290 is also provided, as seen in isolation in FIGS. 52-53. The exhaust valve has an interior face 291. The exhaust valve is covered with a cover 295, as seen in isolation in FIGS. 54-55. An exhaust valve spring 300 and screws 305 are further provided, as can be seen in FIG. 7. The spring 300 biases the exhaust valve 290 to its closed position. Spring 300 is held in place within seats formed in the exhaust valve 290 and cover 295, respectively. The valve opens when pressure inside the compression cavity 190 exceeds the pressure on the outside of the compressor adjacent to the exhaust valve 290.

Figure 56:
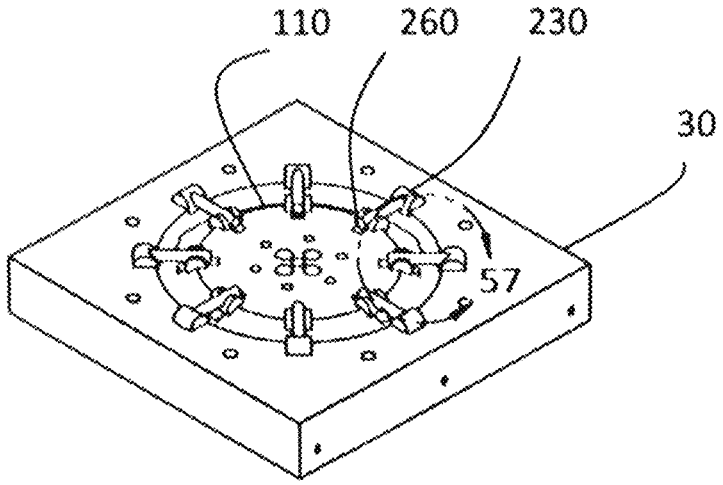
FIG. 56 is a partial assembly view of the compression pump illustrated in FIG. 1.
Figure 57:
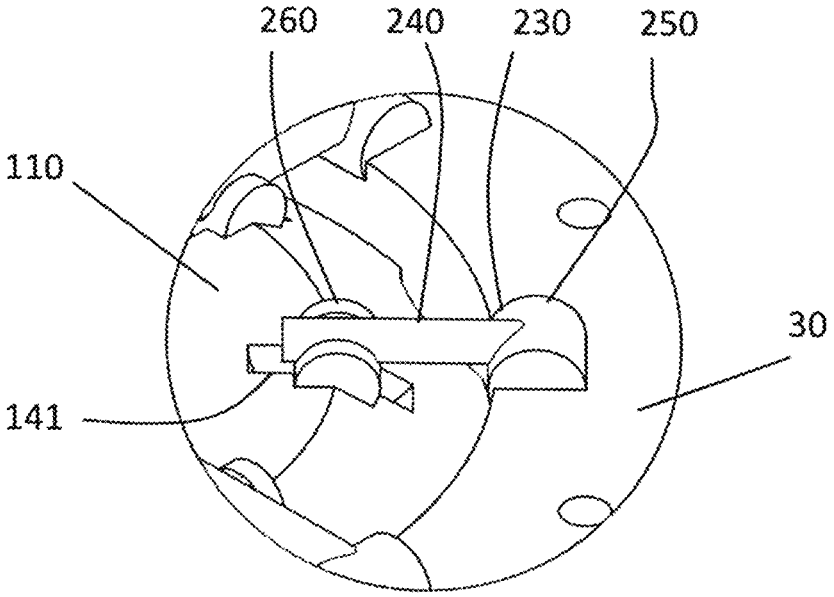
FIG. 57 is a close-up view of a portion of FIG. 56.
Figure 58:
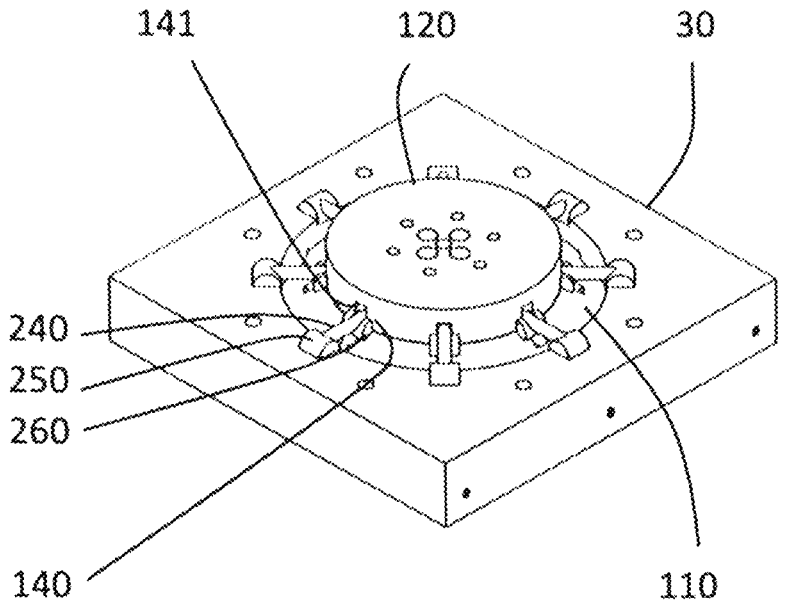
FIG. 58 is a partial assembly view of the compression pump illustrated in FIG. 1.
Figure 59:
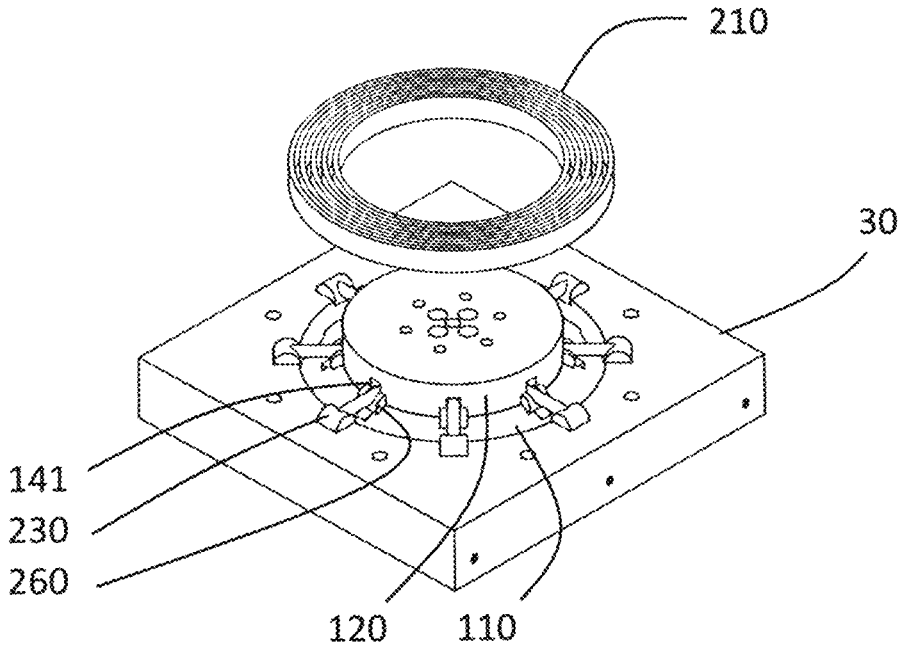
FIG. 59 is a partial assembly and exploded view of the compression pump illustrated in FIG. 1.
Figure 60:
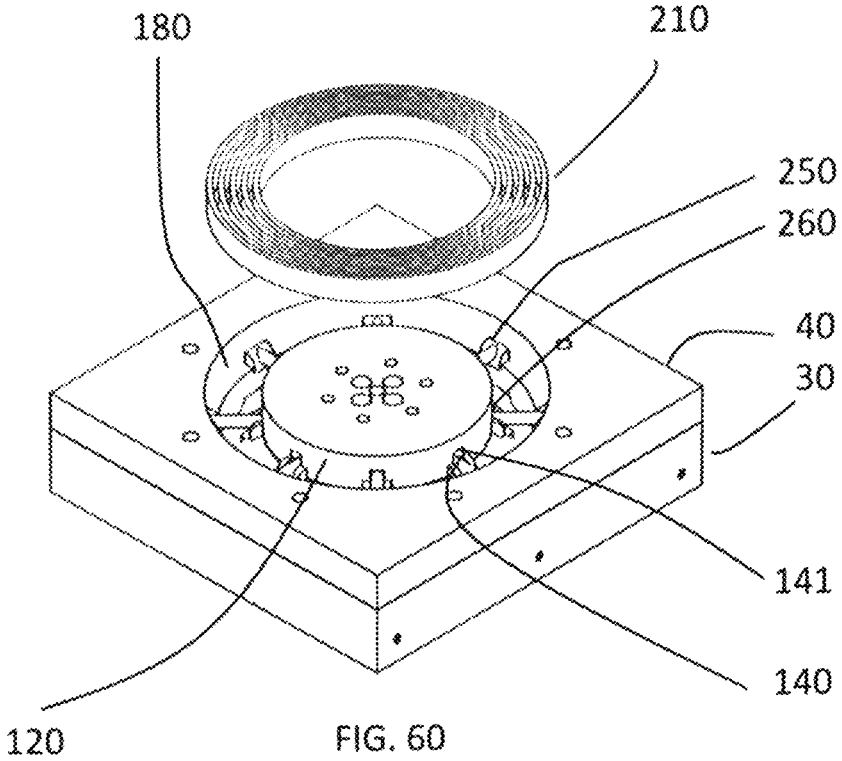
FIG. 60 is a partial assembly and exploded view of the compression pump illustrated in FIG. 1.
Figure 61:
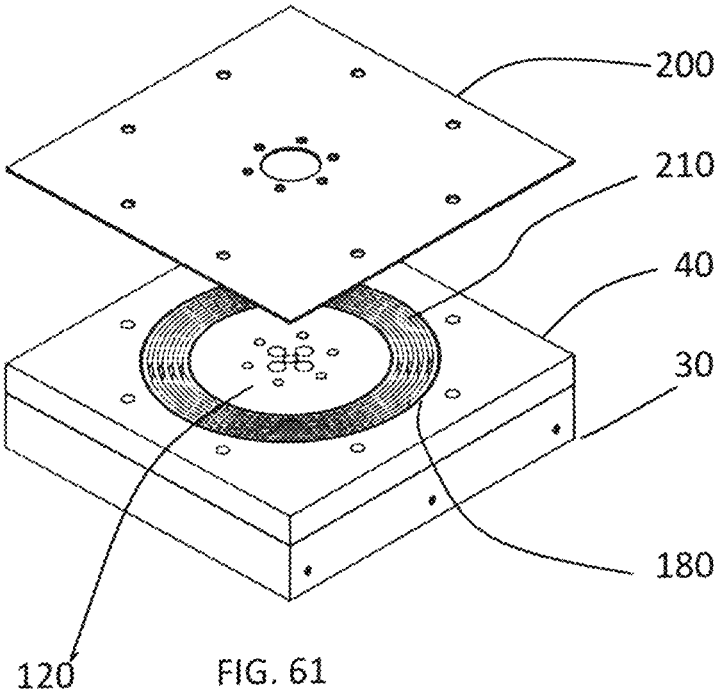
FIG. 61 is a partial assembly and exploded view of the compression pump illustrated in FIG. 1.
Figure 62:
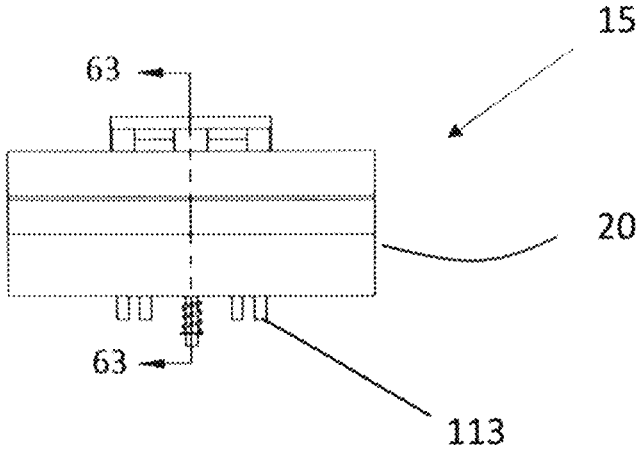
FIG. 62 is a side view of the compression pump at bottom dead center.
Figure 63:
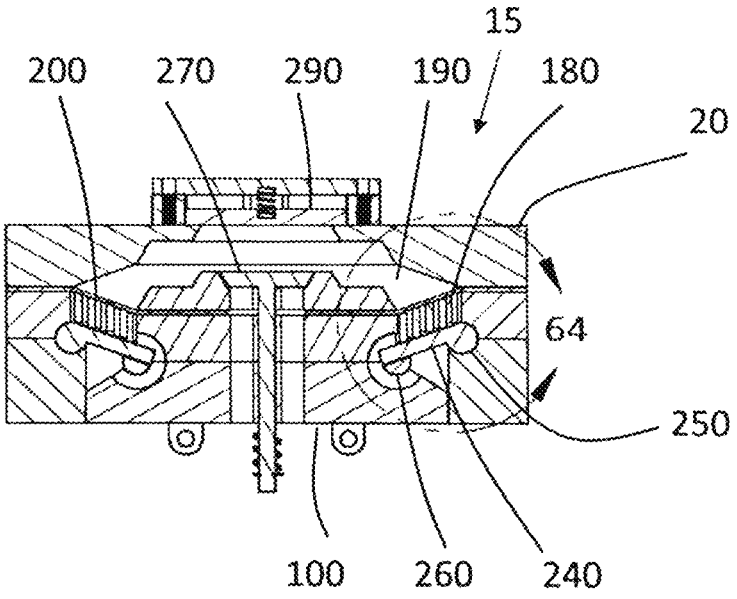
FIG. 63 is a cross-sectional view taken along line 63-63 in FIG. 62.
Figure 64:
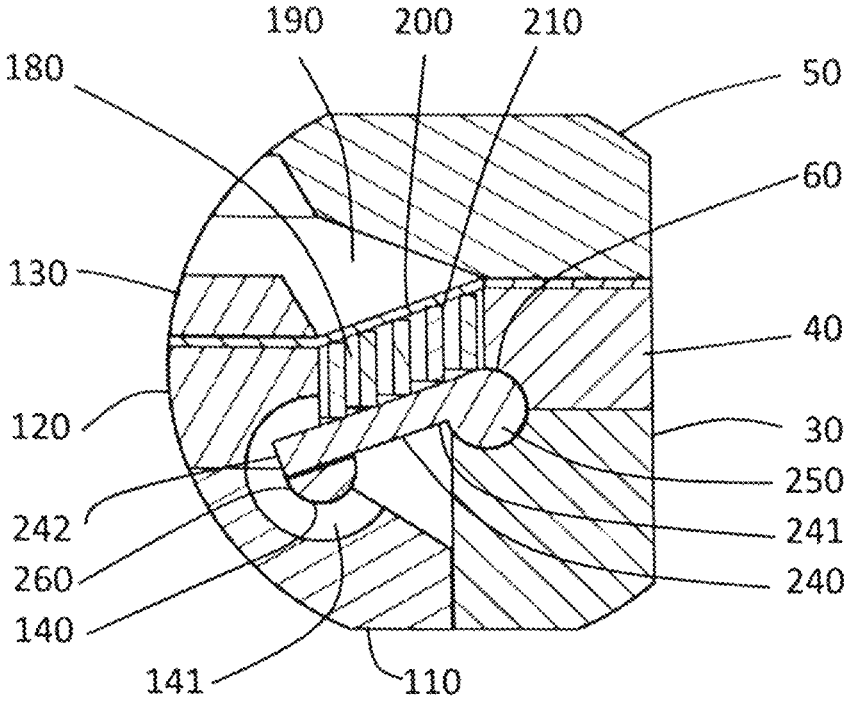
FIG. 64 is a close-up view of a portion of FIG. 63.
Figure 65:
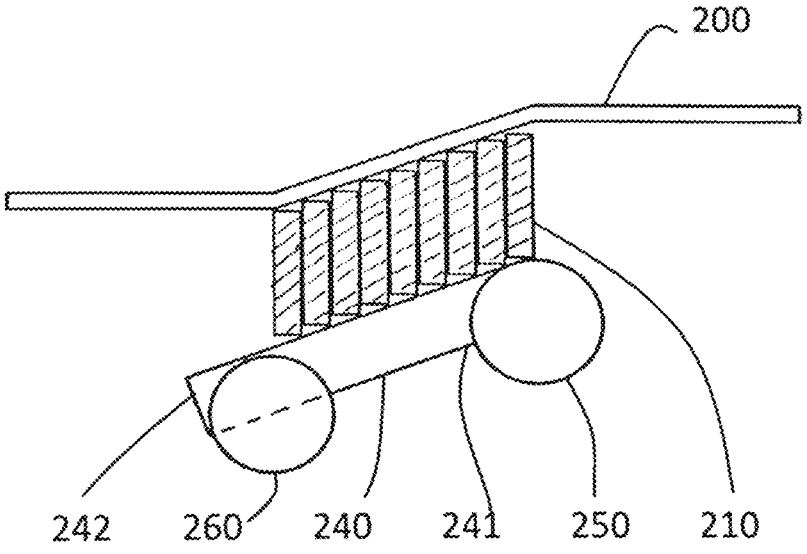
FIG. 65 is a schematic view of the bladder, slide support, bridge and groove bearing at bottom dead center.
Figure 66:
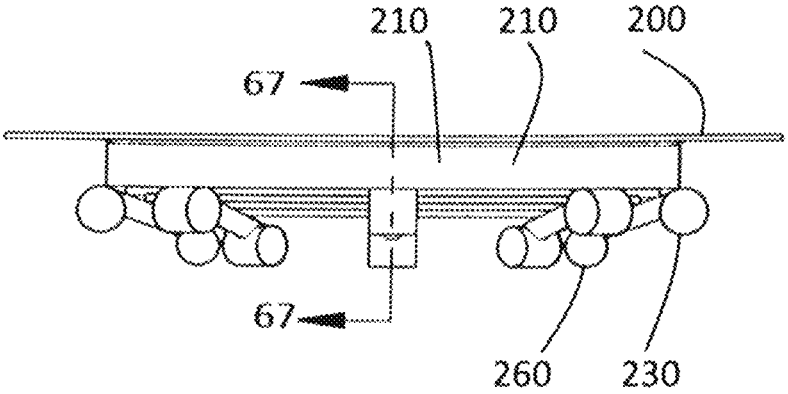
FIG. 66 is a side view of the bladder, slide support, bridge and groove bearing at bottom dead center.
Figure 67:
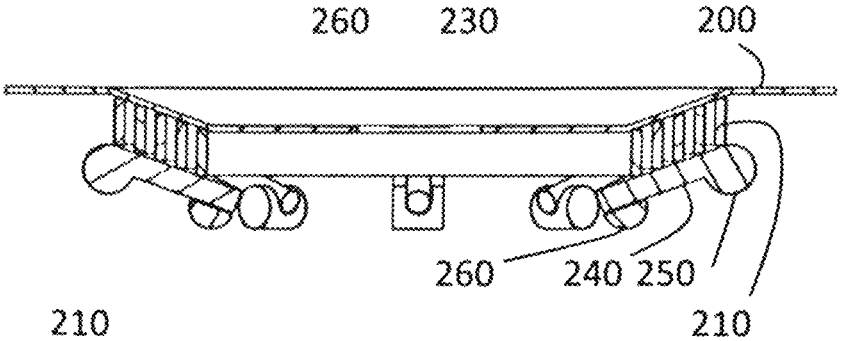
FIG. 67 is a cross-sectional view taken along line 67-67 in FIG. 66.
Figure 68:
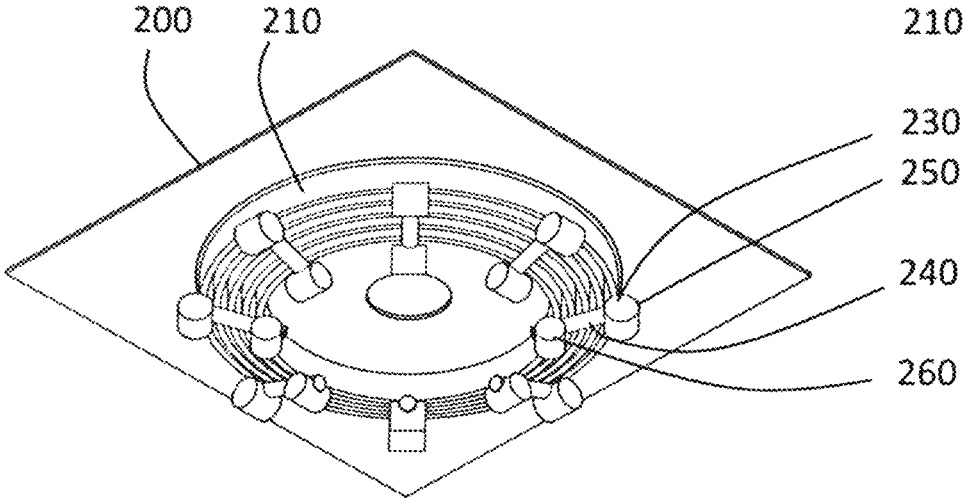
FIG. 68 is a lower perspective view of the components shown in FIG. 66.
Figure 69:
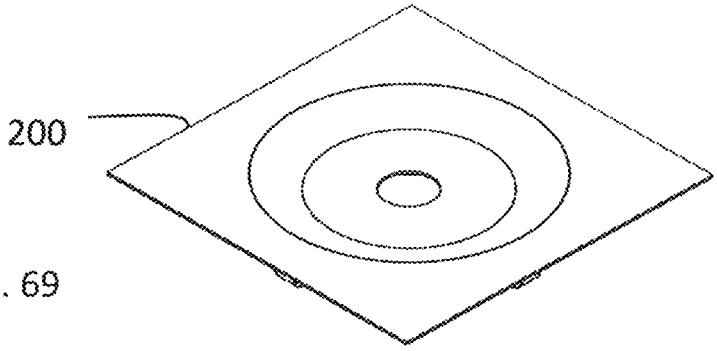
FIG. 69 is an upper perspective view of the components shown in FIG. 66.
Figure 70:
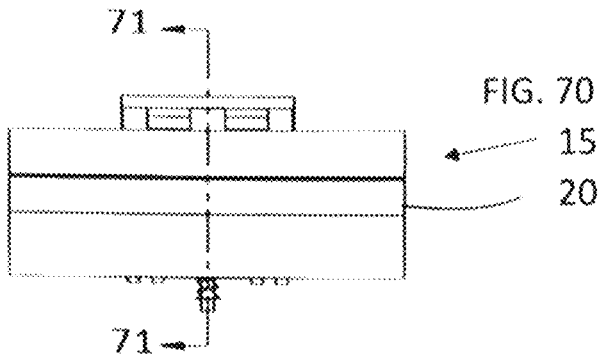
FIG. 70 is a side view of the compression pump at a middle position.
Figure 71:
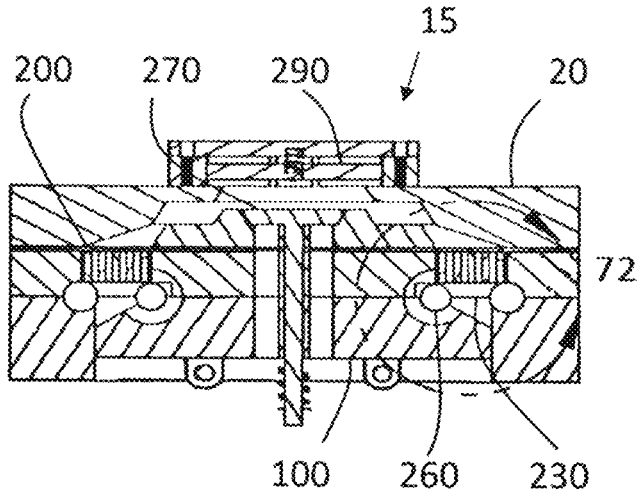
FIG. 71 is a cross-sectional view taken along line 71-71 in FIG. 70.
Figure 72:
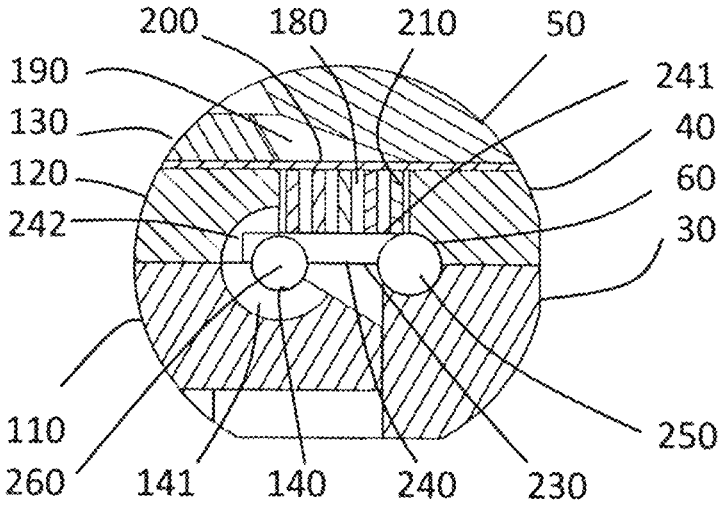
FIG. 72 is a close-up view of a portion of FIG. 71.
Figure 73:
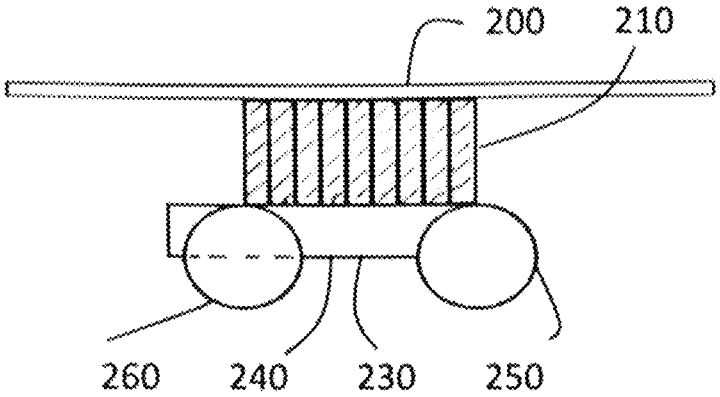
FIG. 73 is a schematic view of the bladder, slide support, bridge and groove bearing at a point midway between top dead center and bottom dead center.
Figure 74:
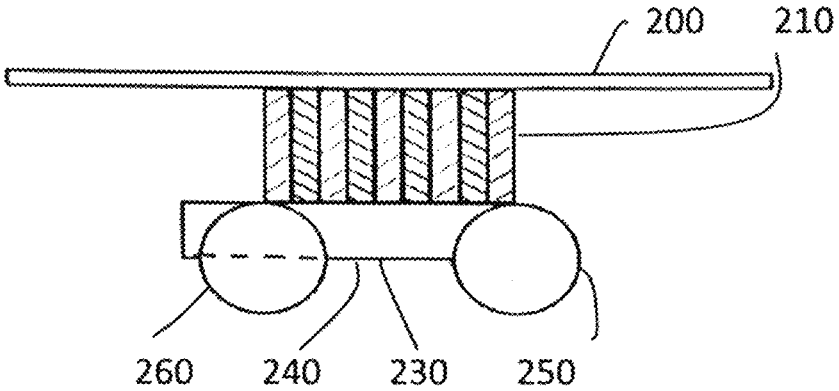
FIG. 74 is similar to FIG. 73 but shows adjacent layers of the slide support having different materials.
Figure 75:
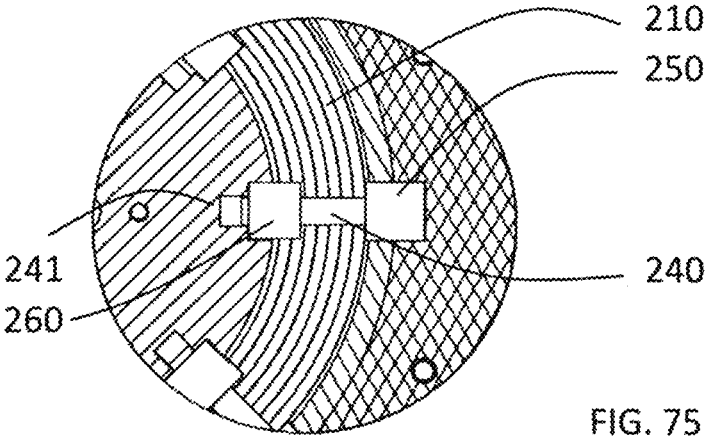
FIG. 75 is a top view showing the slide support supported by the bridge and groove bearing.
Figure 76:
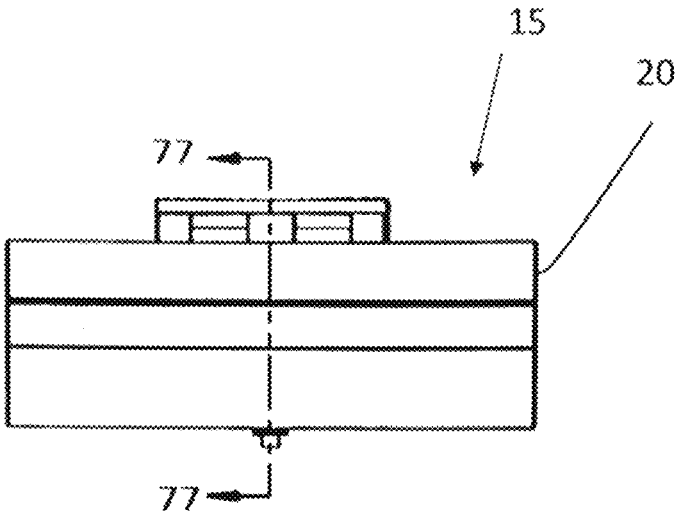
FIG. 76 is a side view of the compression pump at top dead center.
Figure 77:
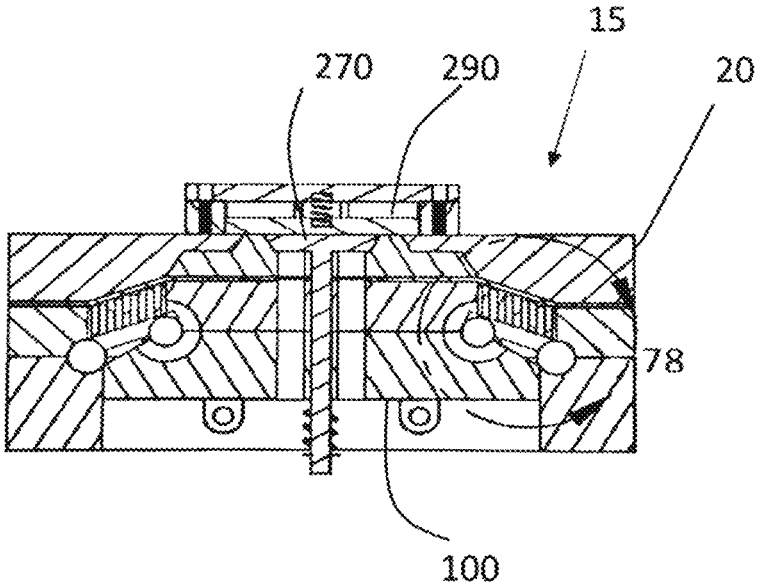
FIG. 77 is a cross-sectional view taken along line 77-77 in FIG. 76.
Figure 78:
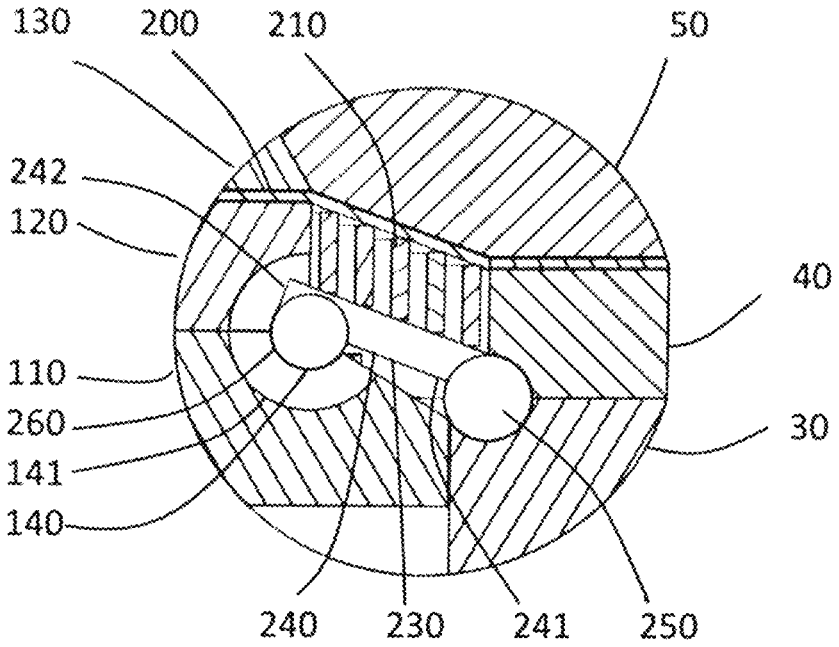
FIG. 78 is a close-up view of a portion of FIG. 77.
Figure 79:
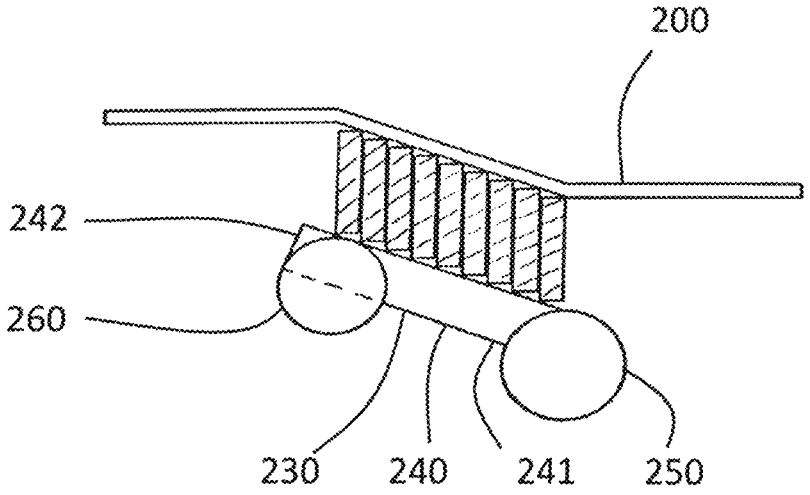
FIG. 79 is a schematic view of the bladder, slide support, bridge and groove bearing at top dead center.
Figure 80:
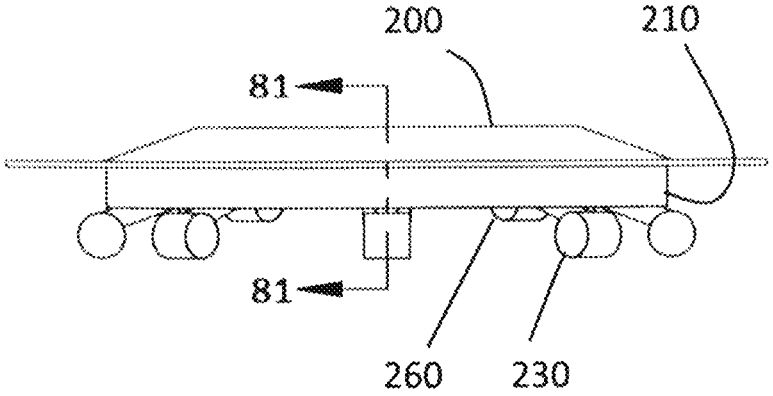
FIG. 80 is a side view of the bladder, slide support, bridge and groove bearing at top dead center.
Figure 81:
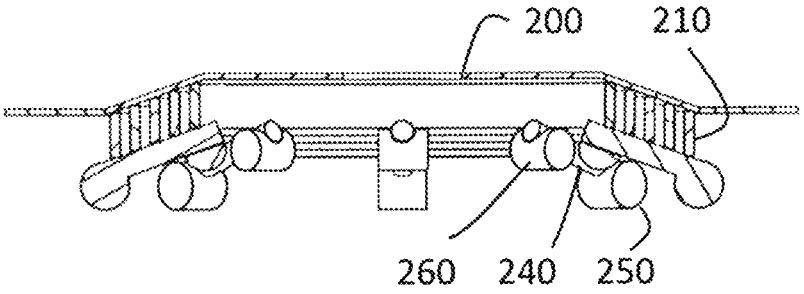
FIG. 81 is a cross-sectional view taken along line 81-81 in FIG. 80.
Figure 82:
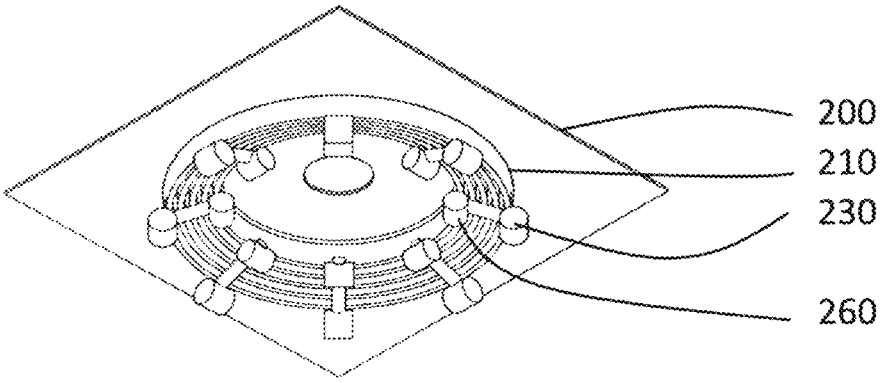
FIG. 82 is a lower perspective view of the components shown in FIG. 80.
Figure 83:
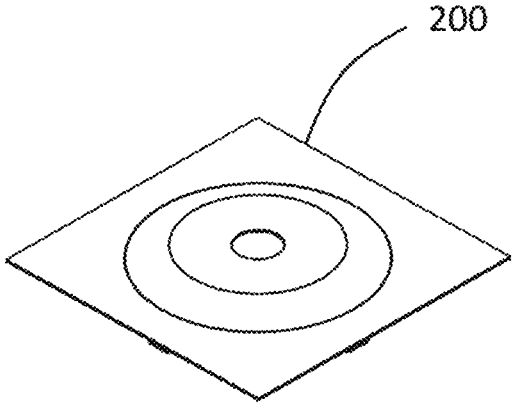
FIG. 83 is an upper perspective view of the components shown in FIG. 80.
Figure 84:
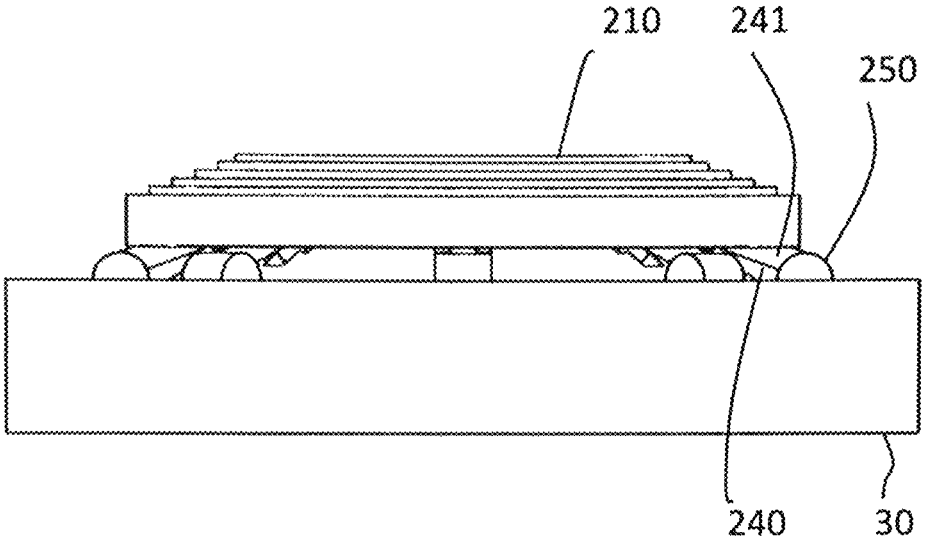
FIG. 84 is a side view of the housing entrance section, slide support, bridge and groove bearing at top dead center.

An assembly sequence is illustrated in FIGS. 56-62. As seen in FIGS. 56 and 57, the bridge bearings 250 are in the bottom portion 60A of the housing seats 60, and the groove bearings 260 are in the bottom portion of the piston seats 140. The piston middle section 120 can then be stacked on the piston inlet section 110 to encapsulate the groove bearings 260 within the piston seats 140, as seen in FIG. 58. The housing center section 40 is stacked on the housing entrance section 30 to encapsulate the bridge bearings 250 within housing seat 60, as seen in FIG. 60. Looking at FIGS. 59 and 60, it is seen that the slide support 210 is ready to be inserted into the support void 180. The slide support 210 is in the support void 180 in FIG. 61, and the bladder is shown in an exploded position.

The bridge bearing and rod, groove bearing, support structure and bladder all fully cooperate with the piston and housing as the piston moves from TDC to BDC, thereby providing support on the low-pressure side of bladder. Due to this support, the pump can operate with a large pressure ratio (high-pressure side/low-pressure side), thereby allowing for the compression of a gas.

Looking at FIGS. 62-84, the movement of the piston 100 in relationship to the housing 20, the bridge 230 (with rod 240 and bearing 250), the groove bearing 260, the support structure 210 and bladder 200 are shown in three positions, BDC (FIGS. 62-69), Middle (FIGS. 70-75) and TDC (FIGS. 76-84). Although a compression cycle is described here, the same movement of all these parts occurs during both compression and intake cycle.

At BDC, a low-pressure gas has been drawn into the compression cavity 190. The piston 100 and the groove bearing 260 are at maximum distance from the housing crown 50. The bridge 230 and rod 240 are angled and seated in the groove bearing 260. The support structure 210 is in a conical position. The combination of this arrangement supports the low-pressure side of the bladder 200.

In the piston middle position, the piston 100 and groove bearing 260 have moved closer to the housing crown. The bridge 230 and rod 240 are now midway between the BDC and TDC position. The rod 240 remains seated in the groove bearing 260 and is perpendicular to the housing inner walls. The slide support is now in a flat position. The combination of this arrangement supports the low-pressure side of the bladder 200 as pressure within the compression cavity increases.

At TDC, the piston 100 and groove bearing 260 have moved to their maximum extension. The bridge 230 and rod 240 are angled (opposite of angle at BDC) and seated in the groove bearing 260. The slide support structure 210 is in a conical position. The combination of this arrangement supports the low-pressure side of the bladder 200. The high-pressure gas has been fully evacuated from the compression cavity 190 through the exhaust valve 290, as the bladder 200, piston head 130 and housing crown 50 are almost touching.

Figure 85:
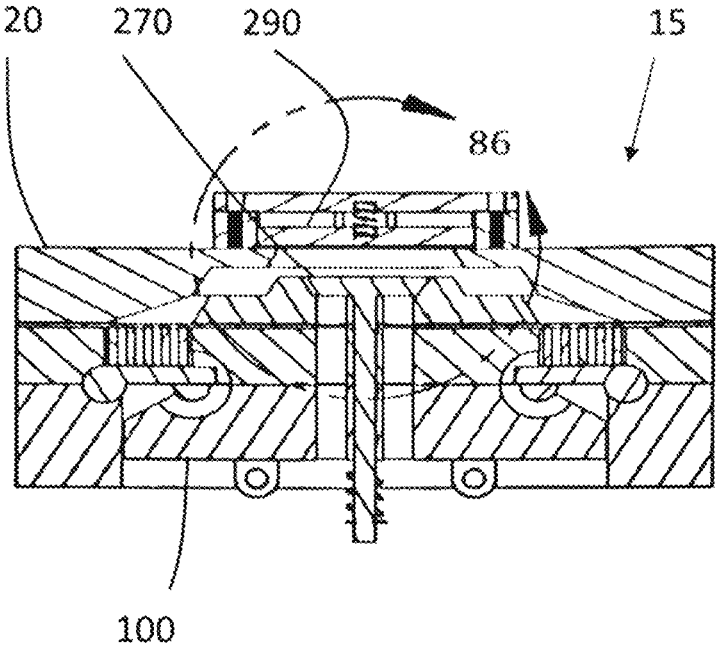
FIG. 85 is a cross-sectional view of the compressor shown during a compression stroke when the pressure inside the compression chamber is less than the pressure outside the compression chamber, wherein the exhaust valve is closed.
Figure 86:
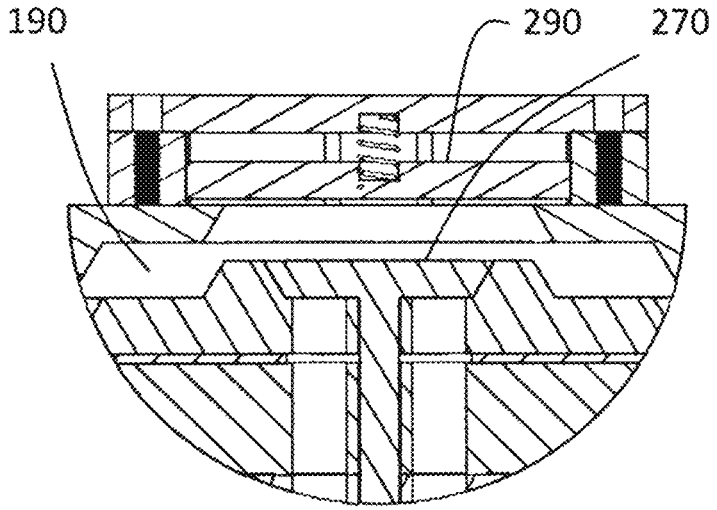
FIG. 86 is a close-up view of a portion of FIG. 85.

Turning now to FIGS. 85-86, the compressor is at a point in the compression stroke where pressure inside the compression chamber is less than the pressure exterior of the compressor outlet. In this position, the inlet valve 270 is closed, as is the exhaust valve 290. The bottom of the piston inlet section 110 is generally flush with the bottom of the housing entrance section 30 when the high pressure to low pressure ratio is approximately 2 to 1.

Figure 87:
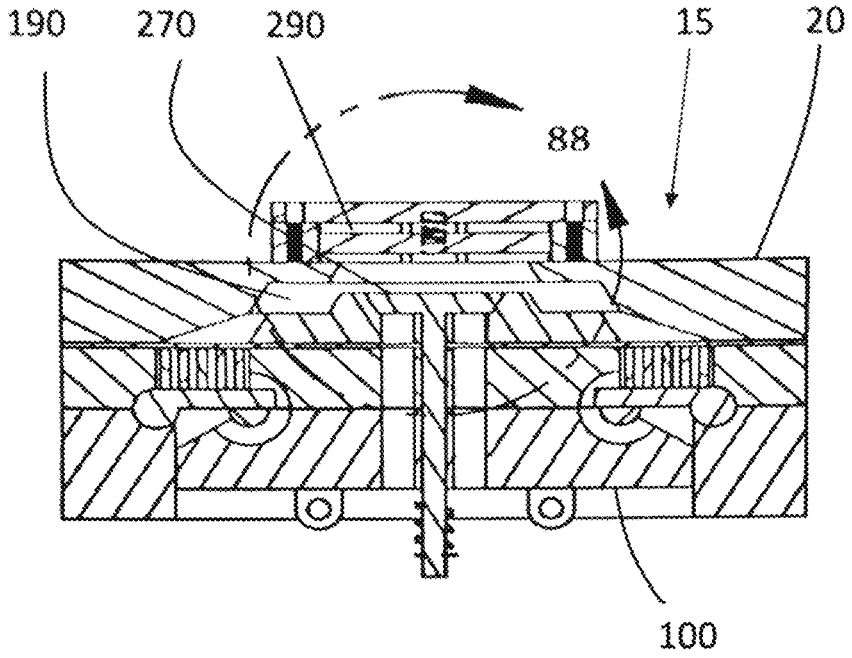
FIG. 87 is a cross-sectional view of the compressor shown during a compression stroke when the pressure inside the compression chamber is greater than the pressure outside the compression chamber, wherein the exhaust valve is open.
Figure 88:
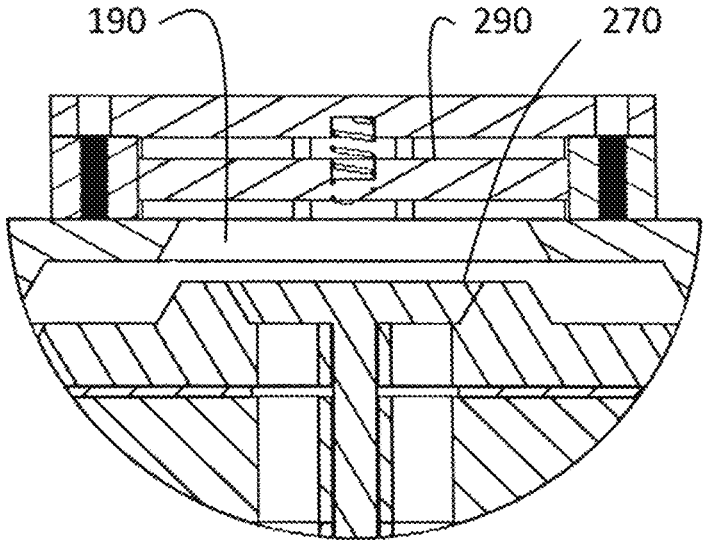
FIG. 88 is a close-up view of a portion of FIG. 87.

The compressor 15 is shown in a second compression position (pressure in compression cavity 190 exceeds external pressure) in FIGS. 87-88 and the exhaust valve 290 is open. The inlet valve 270 is closed throughout the entire compression stroke.

Figure 89:
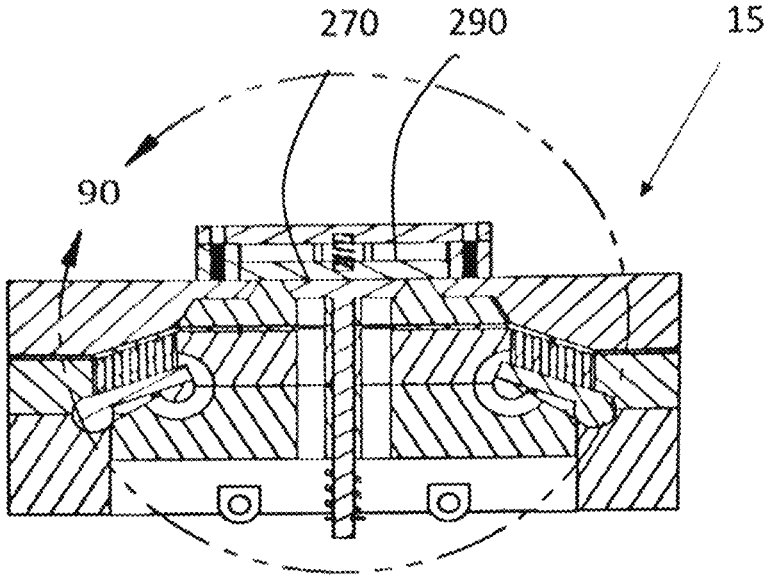
FIG. 89 is a cross-sectional view of the compressor at top dead center showing full evacuation of the compression cavity.
Figure 90:
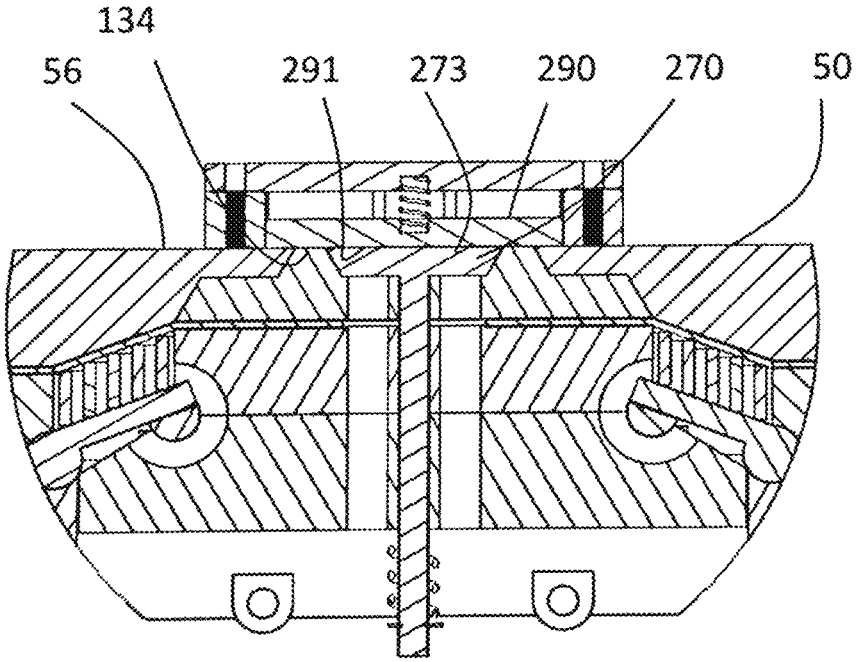
FIG. 90 is a close-up view of a portion of FIG. 89.

The compressor 15 is shown at top dead center in FIGS. 89-90. In this position, the piston head section 130 mates with the housing crown section 50 (face 132 of the piston head section 130 engages face 53 of the housing crown section 50, wall 131 of the head section 130 engages middle wall 52 of the crown section 50, and inner wall 133 of the piston head section 130 engages inner wall 54 of the housing crown section 50). The interior surface 291 of the exhaust valve 290, the distal end 273 of the inlet valve 270, the piston head section distal face 134 and the housing crown section exterior face 56 all lie in the same plane (as the compression cavity 190 is fully evacuated).

Figure 91:
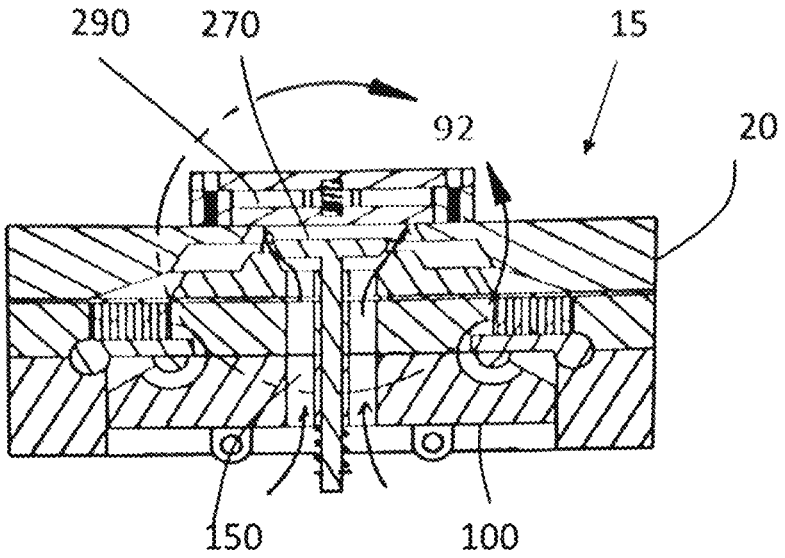
FIG. 91 is a cross-sectional view of the compressor shown during an intake stroke when the intake valve is open and the exhaust valve is closed.
Figure 92:
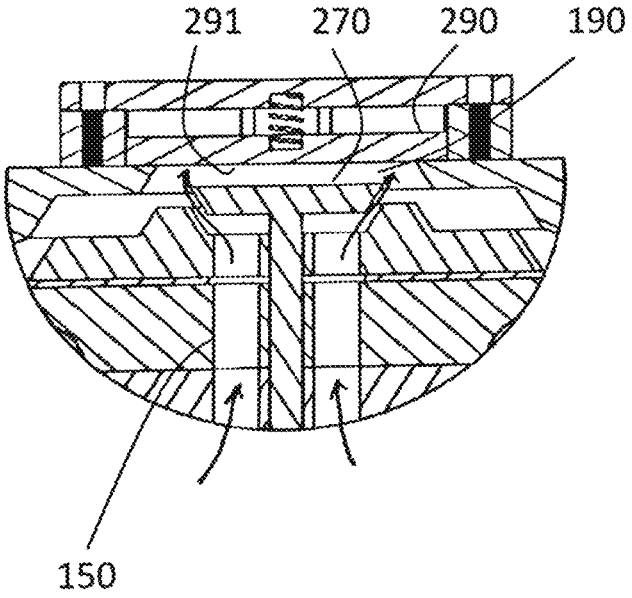
FIG. 92 is a close-up view of a portion of FIG. 91.

The compressor 15 is shown during the intake stroke in FIGS. 91-92. During intake, the inlet valve 270 is open, which allows refrigerant or another medium to enter into the compression cavity 190 through the inlet ports 150. The exhaust valve 290 is closed during the intake stroke.

Turning now to FIG. 93, is it seen that two mounting plates 360 are illustrated. The mounting plates 360 are used to support three compressors to make a compressor assembly. Each mounting plate 360 has a generally triangular configuration with three sides 361, 362 and 363, respectively. Each of the sides preferably has the same length. Three corners, 365, 366 and 367, respectively, are also provided. Three compressors 15, 400 and 410 can be mounted to two plates 360, as seen in FIGS. 94-97. An offset drive assembly, 420 having a housing 430, a drive shaft 435 and piston arms 440, is illustrated in FIG. 97. There are preferably three compressors in operation at the same time (offset by 120 degrees) to smooth out the output of the compressor assembly 350. Four piston arms can be used with each piston to keep the piston moving along the piston axis with respect to the respective housing.

Figure 98:
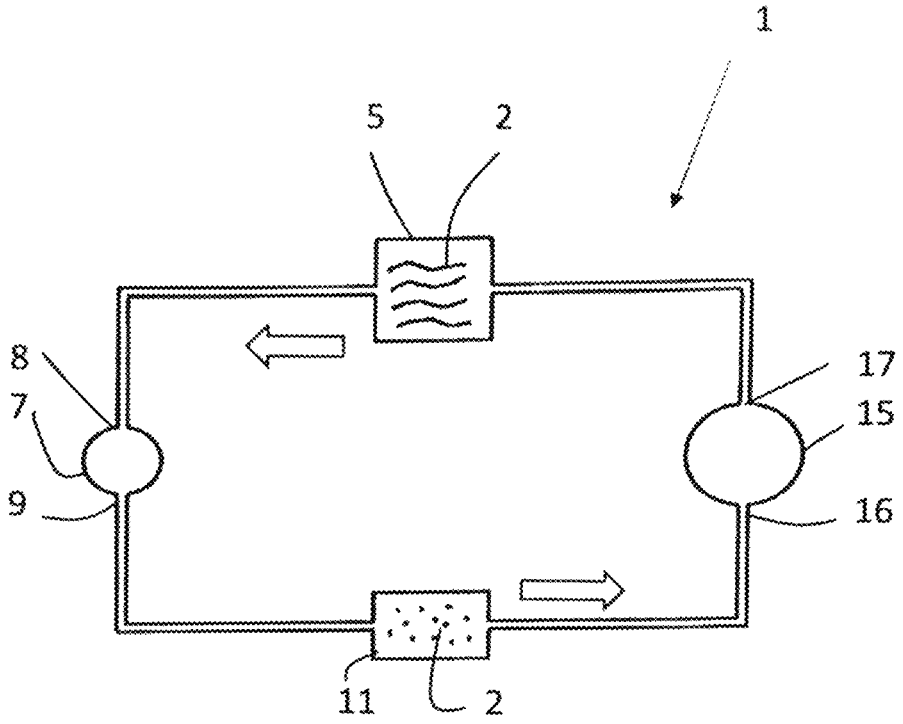
FIG. 98 is a schematic view of a refrigeration system.

It is appreciated that, since high friction parts are not present in the compression cavity, that a refrigeration system, such as the system illustrated in FIG. 98, can operate without oil in the refrigerant.

It is appreciated that the inlet valve can enter in different parts of the compressor without departing from the broad aspects of the present invention. Specifically, the benefit of supporting a bladder with a support structure are realized regardless of the location of the inlet valve. In an alternative embodiment, as illustrated in FIGS. 102-108, it is seen that a compressor 515 is provided having a housing 520 and a piston 540. The housing 520 has a crown section 530 with an inlet 531 and an outlet 532. An inlet valve 535 could operate with the inlet 531, and an exhaust valve 536 could operate with the outlet or exhaust 532. The inlet valve 535 opens during the intake stroke, and the exhaust valve 536 opens during the compression stroke, similar to the valves of the compressor 15 described above. It is noted that there is no valve through the piston 540 in the compressor 515 in embodiments where the inlet and outlet are through the piston. The compressor 515 has a support structure 550 that supports the low-pressure side of a bladder 560. The support structure 550, bladder 560, bridge 570 and groove bearing 580 cooperate as described above. Bladder 560 could be similar to the bladder 200, but without central holes therethrough.

It is appreciated that, in an additional alternative embodiment, the exhaust could be formed through the piston, and that the inlet could be formed through the housing.

Figure 109:
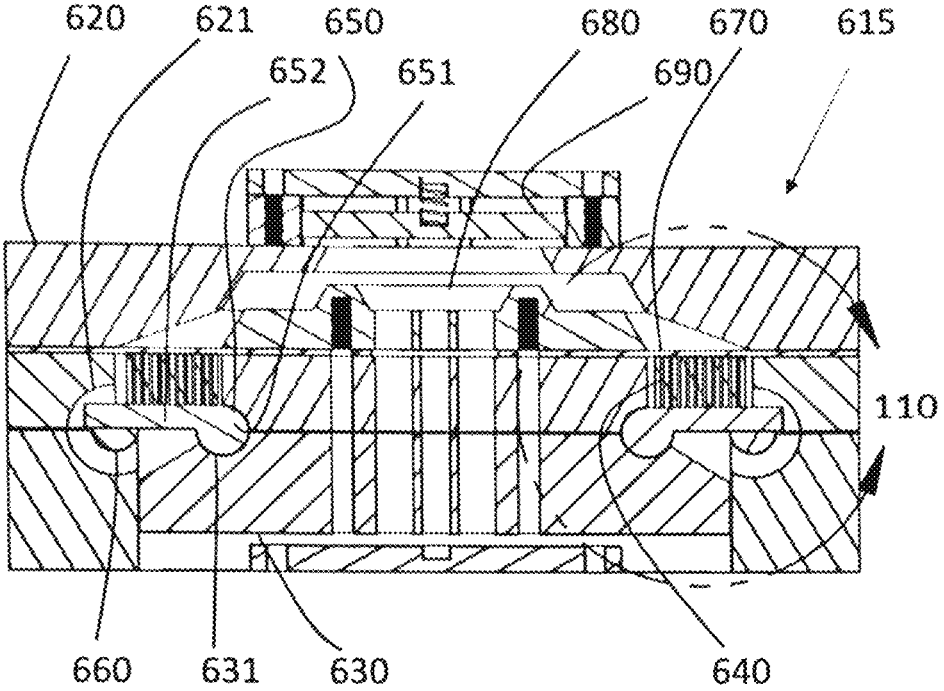
FIG. 109 is a cross-sectional view showing an embodiment wherein a groove bearing is supported by the housing and a bridge bearing is supported by the piston.
Figure 110:
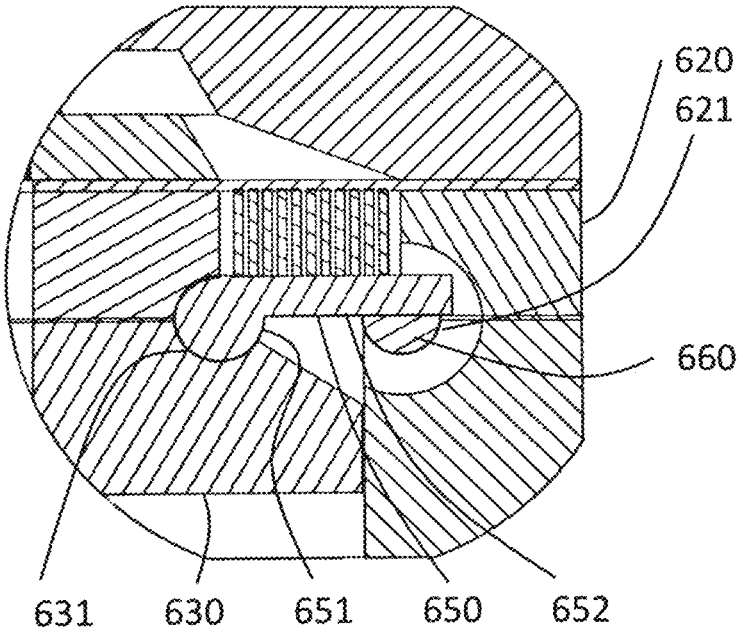
FIG. 110 is a close-up view showing a portion of FIG. 109.

It is appreciated that in a further embodiment, illustrated in FIGS. 109 and 110, that a compressor 615 is provided having a housing 620 with a housing seat 621, and a piston 630 with a piston seat 631. A support structure 640 is provided, and is driven by a rod 652 of a bridge 650. The bridge 650 also has a bridge bearing 651. The bridge bearing 651 is received and rotatable within the piston seat 631. A groove bearing 660 is received within the housing seat 621. The support structure 640 supports a low-pressure side of a bladder 670. An inlet valve 680 and exhaust valve 690 are further provided. Compressor 615 preferably operates similarly as compressor 15, even though the location of the bridge and groove bearing are reversed (in comparison to their respective locations in compressor 15).

It is appreciated that there are several unique structural features according to various aspects of the present invention. These features can be utilized individually or combined with other features in any possible way, such as being coupled with other features, tripled with other features and/or used all together without departing from the broad aspects of the present invention. For example, each of the following features could be used individually or in any manner or combination:

A compression pump comprising: a housing; a piston, said piston being movable within said housing; an inlet valve; an exhaust valve; a bladder, said bladder, said housing and said piston defining a compression cavity; and a support structure supporting a low-pressure side of said bladder.

A compression pump comprising: a housing; an inlet valve; an exhaust valve; a piston; a bladder with a high-pressure side and a low-pressure side; a slide support supporting said bladder on said low-pressure side; a groove bearing supported by a first one of said housing or said piston; and a bridge having a bridge bearing supported by a second one of said housing or said piston, wherein, said groove bearing and said bridge, support said slide support.

A compression pump comprising: a housing having a crown section with a crown section exterior face; a piston having a head section with a head section distal face and a valve seat; an inlet valve seated within said valve seat during a compression stroke, said inlet valve having an inlet valve distal end; an exhaust valve having an exhaust valve interior face; a bladder, said bladder, said crown section and head section defining a compression cavity, said bladder separating said compression cavity from a support void; and a support structure, said support structure being within said support void, at a position of top dead center, said piston is fully received within said housing wherein said head section distal face and said inlet valve distal end are planar with said exterior face of said crown section and the exhaust valve interior face.

Each of these structures can also be combined with each other and/or with one or more of the following features, if not already recited above, by way of example: having the support structure be a slide support, having multiple independent layers, having a cooperating bridge and groove bearing, having a piston seat with a recess, having a plurality of housing seats and piston seats, having a rod with a variable effective length span between the housing and the piston, having a compression cavity that is fully evacuated at top dead center.

It is further appreciated that there are several unique method features according to the present invention. These features can be utilized individually or combined with other features in any possible way, such as being coupled with other features, tripled with other features and/or used all together without departing from the broad aspects of the present invention.

Figure 99:
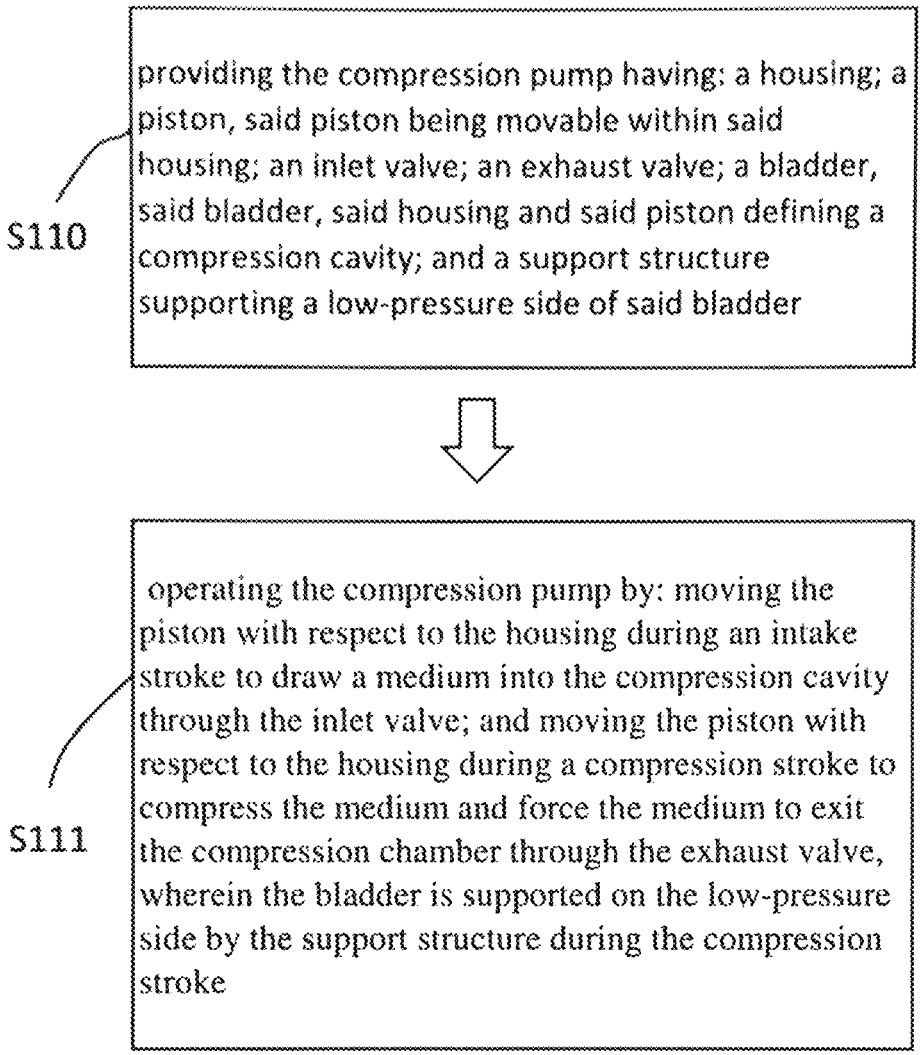
FIG. 99 is a flow chart showing a method of operating a compression pump.

A method of operating a compression pump (FIG. 99), said method comprising the steps: (S110) providing the compression pump having: a housing; a piston, said piston being movable within said housing; an inlet valve; an exhaust valve; a bladder, said bladder, said housing or said piston defining a compression cavity; and a support structure supporting a low-pressure side of said bladder; and (S111) operating the compression pump by: moving the piston with respect to the housing during an intake stroke to draw a medium into the compression cavity through the inlet valve; and moving the piston with respect to the housing during a compression stroke to compress the medium and force the medium to exit the compression chamber through the exhaust valve, wherein the bladder is supported on the low-pressure side by the support structure during the compression stroke.

Figure 100:
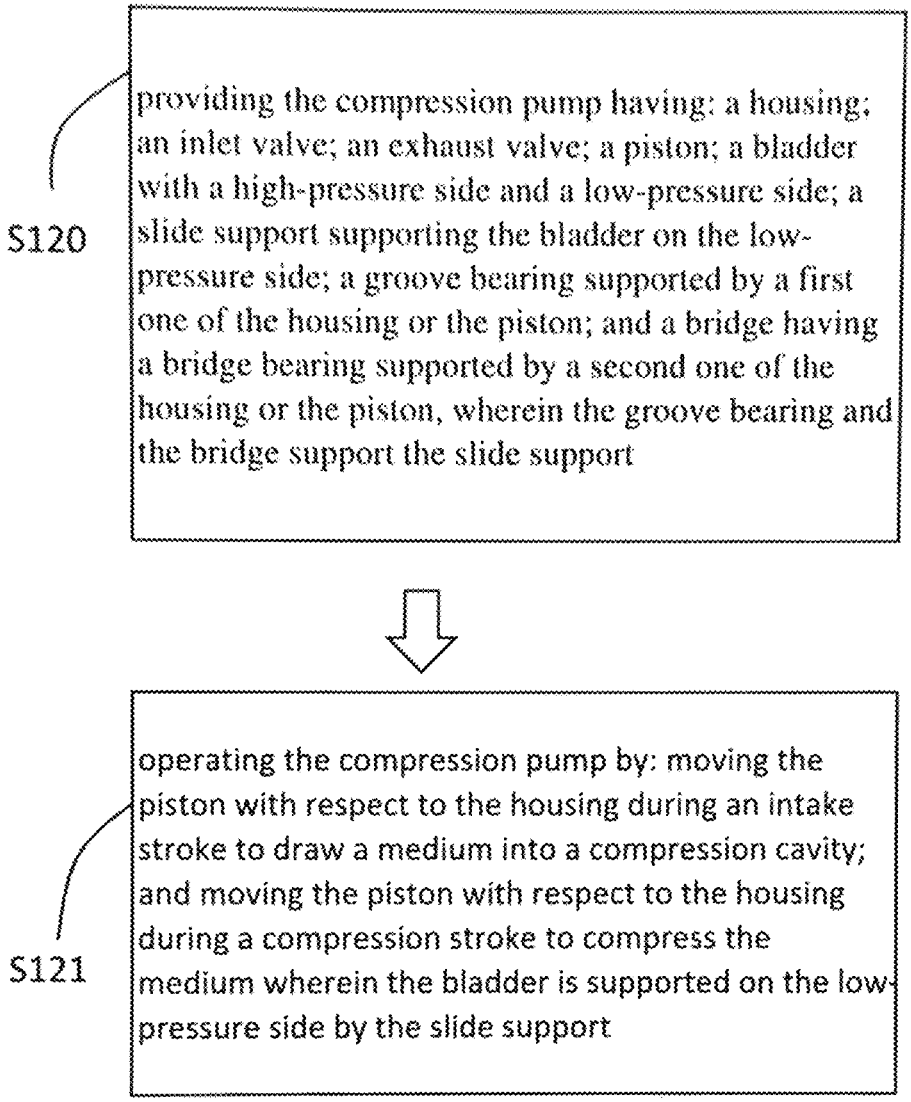
FIG. 100 is a flow chart showing a method of operating a compression pump.

A method of operating a compression pump (FIG. 100) comprising the steps: (S120) providing the compression pump having: a housing; an inlet valve; an exhaust valve; a piston; a bladder with a high-pressure side and a low-pressure side; a slide support supporting the bladder on the low-pressure side; a groove bearing supported by a first one of the housing or the piston; and a bridge having a bridge bearing supported by a second one of the housing or the piston, wherein the groove bearing and the bridge support the slide support; and (S121) operating the compression pump by: moving the piston with respect to the housing during an intake stroke to draw a medium into a compression cavity; and moving the piston with respect to the housing during a compression stroke to compress the medium wherein the bladder is supported on the low-pressure side by the slide support.

Figure 101:
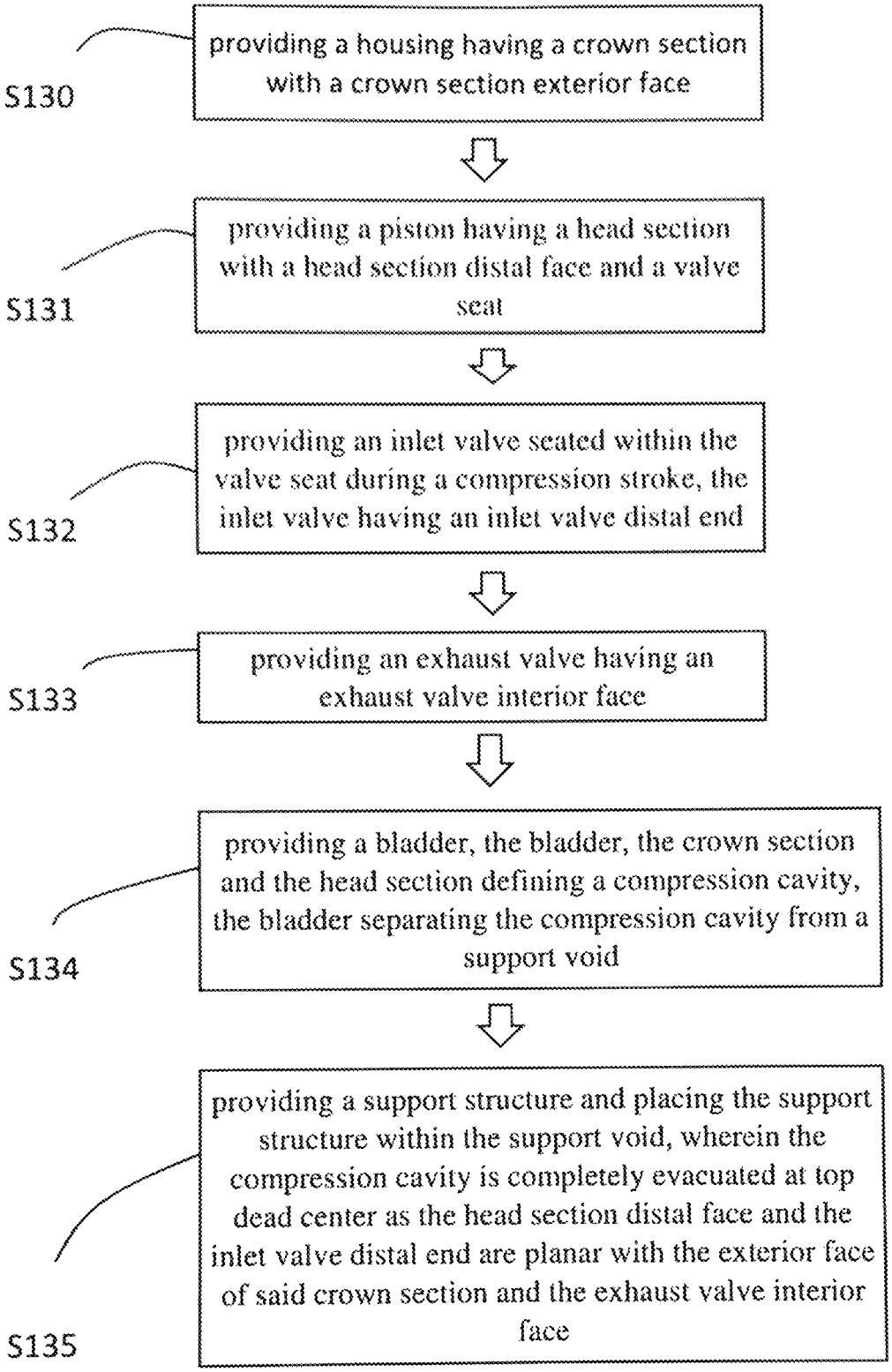
FIG. 101 is a flow chart showing a method of making a compression pump.
Figure 102:
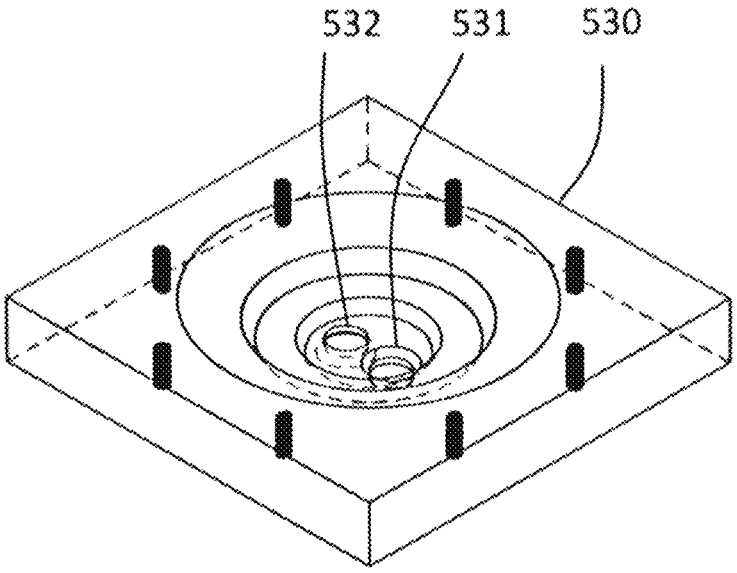
FIG. 102 is lower perspective view of an alternative housing crown section design.
Figure 103:
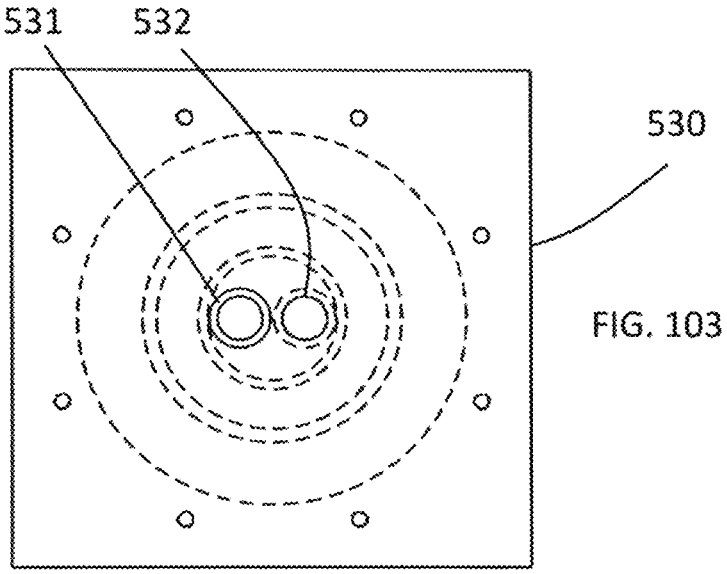
FIG. 103 is a top view of the crown section shown in FIG. 102.
Figure 104:
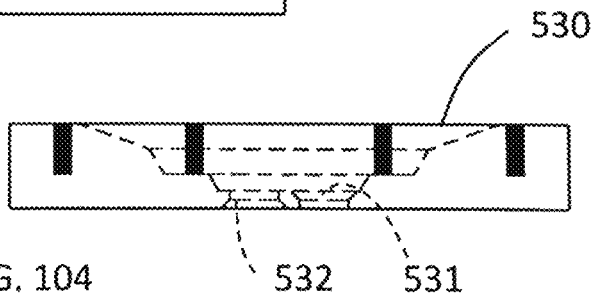
FIG. 104 is a perspective view showing a compressor having the crown section shown in FIG. 102.
Figure 105:
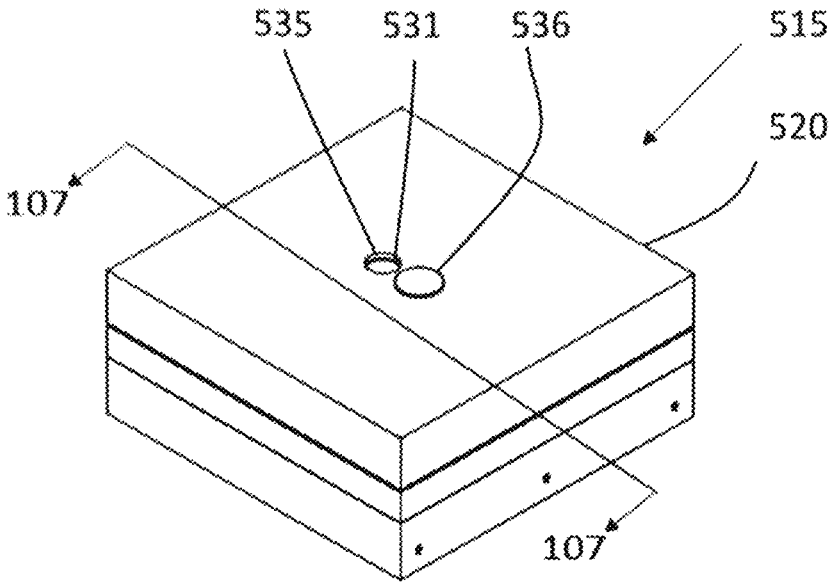
FIG. 105 is a cross-sectional view taken along line 105-105 in FIG. 104.
Figure 106:
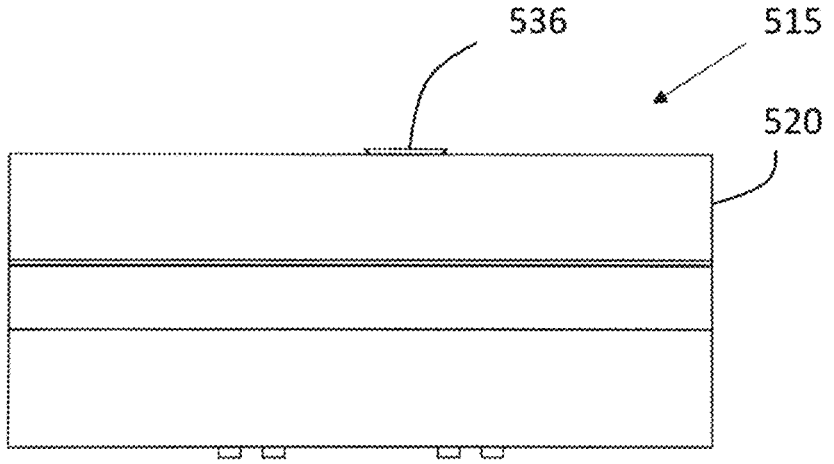
FIG. 106 is a perspective view of the view shown in FIG. 105.
Figure 107:
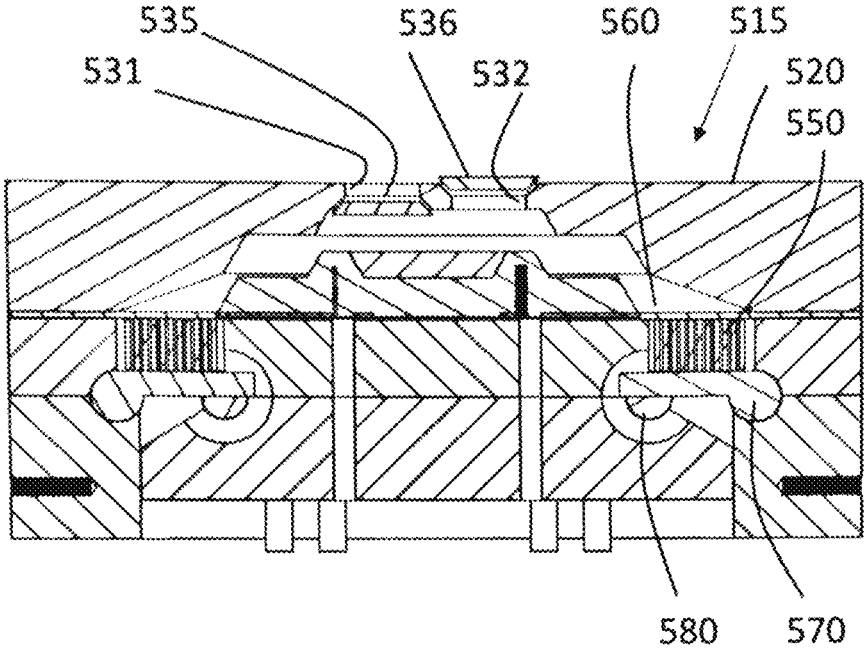
FIG. 107 is a cross-sectional view taken along line 107-107 in FIG. 106
Figure 108:
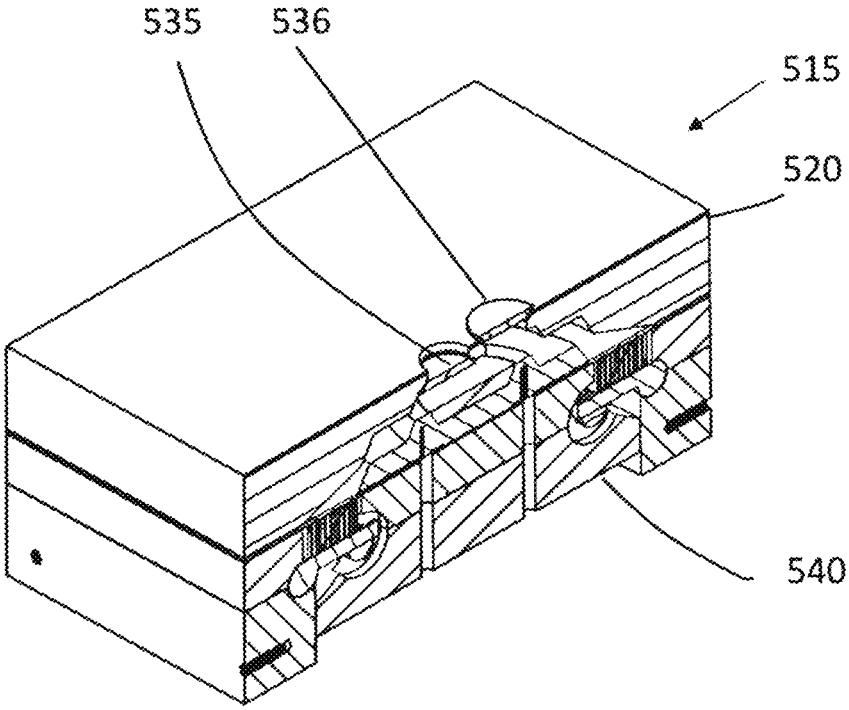
FIG. 108 is a perspective view of the view illustrated in FIG. 107.

A method of making a compression pump (FIG. 101) comprising the steps: (S130) providing a housing having a crown section with a crown section exterior face; (S131) providing a piston having a head section with a head section distal face and a valve seat; (S132) providing an inlet valve seated within the valve seat during a compression stroke, the inlet valve having an inlet valve distal end; (S133) providing an exhaust valve having an exhaust valve interior face; (S134) providing a bladder, the bladder, the crown section and the head section defining a compression cavity, the bladder separating the compression cavity from a support void; and (S135) providing a support structure and placing the support structure within the support void, wherein the compression cavity is completely evacuated at top dead center as the head section distal face and the inlet valve distal end are planar with the exterior face of said crown section and the exhaust valve interior face.

These methods can be modified and/or combined with one or more of the following methods or steps: having the support structure be a slide support, having multiple independent layers, having a cooperating bridge and groove bearing, having a piston seat with a recess, having a plurality of housing seats and piston seats, having a rod with a variable effective length span between the housing and the piston, having a compression cavity that is fully evacuated at top dead center.

Thus, it is apparent that there has been provided, in accordance with the invention, a compression pump that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A compression pump comprising:

a housing;

a piston, said piston being movable within said housing;

an inlet valve;

an exhaust valve;

a bladder, said bladder, said housing and said piston defining a compression cavity; and a support structure supporting a low-pressure side of said bladder, wherein:

said housing has a housing seat;

said piston has a piston seat; and said compression pump further comprises:

a bridge with a rod and a bridge bearing, said bridge bearing being received within either of said housing seat or said piston seat;

a groove bearing with a groove, said groove being open towards said bladder, said groove bearing being received within said housing seat if said bridge bearing is received within said piston seat, or said groove bearing being received within said piston seat if said bridge bearing is received within said housing seat, said rod is slidably received within said groove, and said rod supports said support structure between said housing and said piston.

2. The compression pump of claim 1 wherein said support structure comprises a slide support.

3. The compression pump of claim 2, wherein said slide support is comprised of a plurality of layers, each of said plurality of layers being taller than wide.

4. The compression pump of claim 2 wherein said slide support has a plurality of rings.

5. The compression pump of claim 2 wherein said slide support is a slide coil.

6. The compression pump of claim 5 wherein said slide coil is a first slide coil, and said slide support further comprises a second slide coil.

7. The compression pump of claim 1 wherein:

said bridge bearing is received within said housing seat;

said groove bearing is received within said piston seat;

said piston seat has a recess, said recess accommodating a distal portion of said rod that extends beyond said groove bearing as an effective rod length changes.

8. The compression pump of claim 1 wherein: said housing seat is comprised of a plurality of housing seats; and said piston seat is comprised of a plurality of piston seats, a number of the plurality of housing seats being equal to a number of the plurality of piston seats.

9. The compression pump of claim 1 wherein:

said bridge bearing is received within said housing seat;

said groove bearing is received within said piston seat;

said housing has a center section with a center section inner wall;

said bridge bearing has a bridge bearing fulcrum that is colinear with said center section inner wall;

said piston has a middle section with a middle section outer wall; and said groove bearing has a groove bearing fulcrum that is colinear with said middle section outer wall.

10. The compression pump of claim 1 wherein:

said bladder separates said compression cavity from a support void; and said support structure is received within said support void.

11. The compression pump of claim 1, wherein:

said housing has an entrance section, a center section and a crown section;

said piston has an inlet section, a middle section and a head section;

said bladder has an inner perimeter and an outer perimeter, said inner perimeter being between said middle section and said head section, and said outer perimeter being between said center section and said crown section.

12. The compression pump of claim 11 wherein:

said head section has a head section distal face and a valve seat;

said inlet valve has a head that is received within said valve seat, said inlet valve further having an inlet valve distal end that is planar with said head section distal face when said inlet valve is in a closed position.

13. The compression pump of claim 12 wherein: said crown section has a crown exterior face; and said inlet valve distal end and said head section distal face are planar with said crown exterior face and an interior face of said exhaust valve when said inlet valve is closed and said piston is at top dead center.

14. A compression pump comprising:

a housing;

an inlet valve;

an exhaust valve;

a piston;

a bladder with a high-pressure side and a low-pressure side;

a slide support supporting said bladder on said low-pressure side;

a groove bearing supported by either of said housing or said piston; and a bridge having a bridge bearing supported by said housing if said groove bearing is supported by said piston, or said bridge bearing is supported by said piston if said groove bearing is supported by said housing, wherein, said groove bearing and said bridge, support said slide support, wherein:

said housing comprises an entrance section, a center section and a crown section;

said piston comprises an inlet section, a middle section and a head section;

said housing entrance section comprises a cylinder;

said inlet section is bound by said cylinder;

said bladder has an inner perimeter and an outer perimeter, said outer perimeter being compressed between said center section and said crown section, and said inner perimeter being compressed between said head section and said middle section;

a housing seat is formed between said entrance section and said center section, said housing seat receiving said bridge bearing if said groove bearing is supported by said housing, or said housing seat receiving said groove bearing if said bridge bearing is supported by said housing; and a piston seat is formed between said inlet section and said middle section, said piston seat receiving said groove bearing if said bridge bearing is received within said housing seat, or said piston seat receiving said bridge bearing if said groove bearing is received within said housing seat.

15. The compression pump of claim 14 wherein said slide support has a plurality of rings.

16. The compression pump of claim 14 wherein said slide support is a slide coil.

17. The compression pump of claim 16 wherein said slide coil is a first slid coil, and said slide support further comprises a second slide coil.

18. The compression pump of claim 14, wherein:

said piston seat has a recess;

said bridge further has a rod extending from said bridge bearing;

said groove bearing has a groove that faces the bladder;

said rod is received within said groove; and said rod has a distal end that extends beyond said groove bearing and into said recess as said piston moves towards a center position from either top dead center or bottom dead center.

19. The compression pump of claim 14, wherein:

said crown section has an outlet and an exterior face;

said head section has a head section distal face and a valve seat;

said inlet valve has a head with an inlet valve distal end, said inlet valve being received within said valve seat wherein said inlet valve distal end is planar with said head section distal face;

at a position of top dead center, said piston is fully received within said housing wherein said head section distal face and said inlet valve distal end are planar with said exterior face of said crown section and an exhaust valve interior face.

20. A compression pump comprising:

a housing having a crown section with a crown section exterior face;

a piston having a head section with a head section distal face and a valve seat;

an inlet valve seated within said valve seat during a compression stroke, said inlet valve having an inlet valve distal end;

an exhaust valve having an exhaust valve interior face;

a bladder, said bladder, said crown section and head section defining a compression cavity, said bladder separating said compression cavity from a support void; and a support structure, said support structure being within said support void, at a position of top dead center, said piston is fully received within said housing wherein said head section distal face and said inlet valve distal end are planar with said exterior face of said crown section and the exhaust valve interior face.

21. The compression pump of claim 20 wherein said support structure is a slide support.

22. The compression pump of claim 21 wherein said slide support is one of a plurality or rings or a slide coil.

23. The compression pump of claim 20, wherein:

said housing further has a center section and an entrance section;

said piston further has a middle section and an inlet section;

said entrance section forms a cylinder, said inlet section being bound by said cylinder;

said bladder is connected to said housing between said crown section and said center section; and said bladder is connected to said piston between said head section and said middle section.

24. The compression pump of claim 23, wherein: said compression pump further comprises:

a bridge with a rod and a bridge bearing, said rod extending from said bridge bearing, said bridge bearing having abridge bearing fulcrum; and a groove bearing having a groove and a groove bearing fulcrum;

a housing seat is formed between said entrance section and said center section, said housing seat receiving either of said bridge bearing or said groove bearing;

a piston seat is formed between said inlet section and said middle section, said piston seat receiving said bridge bearing if said groove bearing is received by said housing seat or said piston seat receiving said groove bearing if said bridge bearing is received by said housing seat.

25. The compression pump of claim 24, wherein:

said groove bearing is received within said piston seat;

said bridge bearing is received within said housing seat;

said piston seat has a recess;

said rod is received within said groove; and said rod has a distal end that extends beyond said groove bearing and into said recess as said piston moves towards a center position from either top dead center or bottom dead center as an effective rod length between said bridge bearing fulcrum and said groove bearing fulcrum changes.

26. A compression pump comprising:

a housing;

a piston, said piston being movable within said housing;

an inlet valve;

an exhaust valve;

a bladder, said bladder, said housing and said piston defining a compression cavity; and a support structure supporting a low-pressure side of said bladder, wherein:

said housing has an entrance section, a center section and a crown section;

said piston has an inlet section, a middle section and a head section;

said bladder has an inner perimeter and an outer perimeter, said inner perimeter being between said middle section and said head section, and said outer perimeter being between said center section and said crown section;

said head section has a head section distal face and a valve seat;

said inlet valve has a head that is received within said valve seat, said inlet valve further having an inlet valve distal end that is planar with said head section distal face when said inlet valve is in a closed position;

said crown has a crown exterior face; and said inlet valve distal end and said head section distal face are planar with said crown exterior face and an interior face of said exhaust valve when said inlet valve is closed and said piston is at top dead center.

* * * * *